US007110941B2

(12) United States Patent
Li

(10) Patent No.: US 7,110,941 B2
(45) Date of Patent: Sep. 19, 2006

(54) SYSTEM AND METHOD FOR EMBEDDED AUDIO CODING WITH IMPLICIT AUDITORY MASKING

(75) Inventor: Jin Li, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 1020 days.

(21) Appl. No.: 10/112,020

(22) Filed: Mar. 28, 2002

(65) Prior Publication Data

US 2003/0187634 A1 Oct. 2, 2003

(51) Int. Cl.
*G10L 19/00* (2006.01)
*G10L 21/00* (2006.01)

(52) U.S. Cl. ..... 704/200.1; 704/500; 704/201

(58) Field of Classification Search ..... 704/200.1
See application file for complete search history.

(56) References Cited

U.S. PATENT DOCUMENTS

| | | | | |
|---|---|---|---|---|
| 5,319,735 | A * | 6/1994 | Preuss et al. | 704/205 |
| 6,256,608 | B1 * | 7/2001 | Malvar | 704/230 |
| 6,385,572 | B1 * | 5/2002 | Hu | 704/200.1 |
| 6,499,010 | B1 * | 12/2002 | Faller | 704/229 |
| 6,654,716 | B1 * | 11/2003 | Bruhn et al. | 704/219 |
| 6,778,953 | B1 * | 8/2004 | Edler et al. | 704/200.1 |
| 2004/0024588 | A1 * | 2/2004 | Watson et al. | 704/200.1 |

FOREIGN PATENT DOCUMENTS

EP 0446037 A2 * 9/1991

OTHER PUBLICATIONS

Brandenburg et al., "Transform coding of high quality digital audio at low bit rates-algorithms and implementation", SUPERCOMM/ICC '90, Apr. 16-19, 1990, pp. 932-936, vol. 3.*

Brandenburg et al., "OCF—A new coding algorithm for high quality sound signals", ICASSP '87, Apr. 1987, pp. 141-144, vol. 12.*

Dobson et al., "High quality low complexity scalable wavelet audio coding", ICASSP-97, Apr. 21-24, 1997, pp. 327-330, vol. 1.*

Drygajlo et al., "Integrated speech enhancement and coding in the time-frequency domain", ICASSP-97, Apr. 21-24, 1997, pp. 1183-1186, vol. 2.*

(Continued)

*Primary Examiner*—Richemond Dorvil
*Assistant Examiner*—Brian L. Albertalli
(74) *Attorney, Agent, or Firm*—Lyon & Harr, LLP; Mark A. Watson

(57) ABSTRACT

The embedded audio coder (EAC) is a fully scalable psychoacoustic audio coder which uses a novel perceptual audio coding approach termed "implicit auditory masking" which is intermixed with a scalable entropy coding process. When encoding and decoding an audio file using the EAC, auditory masking thresholds are not sent to a decoder. Instead, the masking thresholds are automatically derived from already coded coefficients. Furthermore, in one embodiment, rather than quantizing the audio coefficients according to the auditory masking thresholds, the masking thresholds are used to control the order that the coefficients are encoded. In particular, in this embodiment, during the scalable coding, larger audio coefficients are encoded first, as the larger components are the coefficients that contribute most to the audio energy level and lead to a higher auditory masking threshold.

59 Claims, 10 Drawing Sheets

OTHER PUBLICATIONS

Shen et al., "A progressive approach for perceptual audio coding", ICME 2000, Jul. 30-Aug. 2, 2000, pp. 815-818, vol. 2.*

Shen et al., "A progressive algorithm for perceptual coding of digital audio signals", Conference Record of the Thirty-Third Asilomar Conference on Signals, Systems, and Computers, Oct. 24-27, 1999, pp. 1105-1109, vol. 2.*

Yang et al., "A modified bark spectral distortion measure which uses noise masking threshold", IEEE Workshop on Speech Coding For Telecommunications Proceeding, Sep. 7-10, 1997, pp. 55-56.*

Eberlein et al., "Audio codec for 64 kbit/sec (ISDN channel)-requirements and results", ICASSP-90, Apr. 3-6, 1990, pp. 1105-1108, vol. 2.*

N. S. Jayant, J. D. Johnson, and R. Safranek, "Signal compression based on model of human perception", *Proc. of IEEE*, vol. 81, No. 10, pp. 1385-1422, 1993.

P. Noll, "MPEG digital audio coding standards", *CRC Press, LLC*, 1999.

H. S. Malvar, "Fast adaptive encoder for bi-level images", Proc. Of Data compression conferences, Snowbird, Utah, Mar. 2001, pp. 253-262.

J. Li and S. Lei, "An embedded still image coder with rate-distortion optimization", *IEEE Trans. On Image Processing*, vol. 8, No. 7, pp. 913-924, Jul. 1999.

* cited by examiner

SYSTEM AND METHOD FOR EMBEDDED AUDIO CODING WITH IMPLICIT AUDITORY MASKING

BACKGROUND

1. Technical Field

The invention is related to an audio coder, and in particular, to a fully scalable psychoacoustic audio coder which derives auditory masking thresholds from previously coded coefficients, and uses the derived thresholds for optimizing the order of coding.

2. Related Art

There are many existing schemes for encoding audio files. Several such schemes attempt to achieve higher compression rations by using known human psychoacoustic characteristics to mask the audio file. A psychoacoustic coder is an audio encoder which has been designed to take advantage of human auditory masking by dividing the audio spectrum of one or more audio channels into narrow frequency bands of different sizes optimized with respect to the frequency selectivity of human hearing. This makes it possible to sharply filter coding noise so that it is forced to stay very close in frequency to the frequency components of the audio signal being coded. By reducing the level of coding noise wherever there are no audio signals to mask it, the sound quality of the original signal can be subjectively preserved.

In fact, virtually all state-of-the-art audio coders, including the G.722.1 coder, the MPEG-1 Layer 3 coder, the MPEG-2 AAC coder, and the MPEG-4 T/F coder, recognize the importance of the psychoacoustic characteristics, and adopt auditory masking techniques in coding audio files. In particular, using human psychoacoustic hearing characteristics in audio file compression allows for fewer bits to be used to encode audio components that are less audible to the human ear. Conversely, more bits can then be used to encode any psychoacoustic components of the audio file to which the human ear is more sensitive. Such psychoacoustic coding makes it possible to greatly improve the quality of an encoded audio at given bit rate.

Psychoacoustic characteristics are typically incorporated into an audio coding scheme in the following way. First, the encoder explicitly computes auditory masking thresholds of a group of audio coefficients, usually a "critical band," to generate an "audio mask." These thresholds are then transmitted to the decoder in certain forms, such as, for example, the quantization step size of the coefficients. Next, the encoder quantizes the audio coefficients according to the auditory mask. For auditory sensitive coefficients, i.e., those to which the human ear is more sensitive, a smaller quantization step size is typically used. For auditory insensitive coefficients, i.e., those to which the human ear is less sensitive, a larger quantization step size is typically used. The quantized audio coefficients are then typically entropy encoded, either through a Huffman coder such as the MPEG-4 AAC quantization & coding, a vector quantizer such as the MPEG-4 TwinVQ, or a scalable bitplane coder such as the MPEG-4 BSAC coder.

In each of the aforementioned conventional audio coding schemes, the auditory masking is applied before the process of entropy coding. Consequently, the masking threshold is transmitted to the decoder as overhead information. As a result, the quality of the encoded audio at a given bit rate is reduced to the extent of the bits required to encode the auditory masking threshold information.

Therefore, a system and method for encoding audio files using known human psychoacoustic characteristics to mask the audio file without the need to send auditory masking threshold information as overhead information is favorable. Such a system and method can thus improve audio quality by devoting more bits to encoding of the audio file rather than encoding of auditory masking thresholds.

SUMMARY

A system and method for embedded audio coding with implicit auditory masking solves the aforementioned problems, as well as other problems that will become apparent from an understanding of the following description by providing an embedded audio coder (EAC) which employs a novel psychoacoustic audio coding scheme. The implicit auditory masking system and method described herein has several distinct advantages over conventional audio coding schemes which apply psychoacoustic masking. In particular, audio coding with implicit auditory masking derives auditory masking thresholds from previously coded coefficients, thereby eliminating any overhead associated with the transmission of an auditory mask. Consequently, audio compression efficiency is improved as more bits can be devoted to the coefficient coding, especially at low bit rates. In addition, unlike conventional schemes, the implicit auditory masking approach described herein produces no error sensitive header. Therefore, the bitstream is more robust for transmission over error prone channels, such as a wireless channel.

The EAC is further improved in several alternate embodiments. In particular, in one embodiment, the perceived quality of the coded audio is further improved by using the derived thresholds to change the order of coding so that those audio components that have a greater impact on perceived audio quality are encoded first. In another embodiment, the compressed bitstream generated by the EAC is fully scalable in terms of the coding bit rate, the number of audio channels, and the audio sampling rate. Finally, in still another embodiment, different psychoacoustic models are used at different stages of encoding to improve a perceptual quality of the compressed audio over a wide range of bit rates.

Psychoacoustic masking is well known to those skilled in the art. Consequently, the basic theory behind acoustic or auditory masking will only be described in general terms herein. In general, the basic theory behind auditory masking is that humans do not have the ability to hear minute differences in frequency. For example, it is very difficult to discern the difference between a 1,000 Hz signal and a signal that is 1,001 Hz. It becomes even more difficult for a human to differentiate such signals if the two signals are playing at the same time. Further, studies have shown the 1,000 Hz signal would also affect a human's ability to hear a signal that is 1,010 Hz, or 1,100 Hz, or 990 Hz. This concept is known as masking. If the 1,000 Hz signal is strong, it will mask signals at nearby frequencies, making them inaudible to the listener. In addition, there are two other types of acoustic masking which affects human auditory perception. In particular, as discussed below, both temporal masking and noise masking also effect human audio perception. These ideas are used to improve audio compression because any frequency components in the audio file which fall below a masking threshold can be discarded, as they will not be perceived by a human listener.

In general, the EAC is a fully scalable generic audio coder which uses a novel perceptual audio coding approach termed "implicit auditory masking" that is intermixed with a scalable entropy coding process. Further, in accordance with the EAC described herein, auditory masking thresholds are never sent to the decoder, instead, they are derived from the already coded coefficients. Furthermore, in one embodiment, rather than quantizing the audio coefficients according to the auditory masking thresholds, the masking thresholds are used to control the order that the coefficients are encoded. In particular, in this embodiment, during the scalable coding, larger audio coefficients are encoded first, as the larger components are the coefficients that contribute most to the audio energy level and lead to a higher auditory masking threshold.

In particular, given an audio input of any number of audio channels, the audio input is first preferably separated into individual channel components. For example, given a stereo audio input, the audio input is first sent through a multiplexer (MUX) and separated into L+R and L−R components using conventional techniques. Each component is then encoded separately.

After channel separation, each component of audio is then transformed using either a conventional wavelet transform, or preferably, by a modulated lapped transform (MLT) with switching windows. Both regular MLT with float calculation, and reversible MLT transform with integer calculation (for lossless compression) are used in alternate embodiments. When using float MLT, a scalar quantization is performed on the transformed coefficients to convert the transformed coefficients from float to integer. The size of the MLT window is switchable between 2048 and 256 samples for long and short windows, respectively.

In one embodiment, the MLT transform coefficients are then split into a number of sections. This section split operation enables the scalability of the audio sampling rate. Such scalability is particularly useful where different frequency responses of the decoded audio file are desired. For example, where one or more playback speakers associated with the decoder do not have a high frequency response, or where it is necessary for the decoder to save either or both computation power and time, one or more sections corresponding to particular high frequency components of the MLT transform coefficients can be discarded.

Each section of the MLT transform coefficients is then entropy encoded into an embedded bitstream, which can be truncated and reassembled at a later stage. Further, to improve the efficiency of the entropy coder, the MLT coefficients are grouped into a number of consecutive windows termed a timeslot. In a default setting used in a working example of the EAC, a timeslot consists of 16 long MLT windows or 128 short MLT windows. However, it should be clear to those skilled in the art that the number of windows can easily be changed. Finally, a bitstream assembly module allocates the available coding bit rate among multiple timeslots and channels, truncates the embedded bitstream of each timeslot and channel according to the allocated bit rate, and produces a final compressed bitstream.

In conventional psychoacoustic audio coders, the encoder calculates the auditory masking threshold based on the input audio signal. The masking threshold is then encoded as a part of the compressed bitstream, and is used to control the quantization of the transform coefficients. However, in contrast, with the embedded audio coder (EAC) described herein, the auditory masking is applied in a very different way.

In particular, first, the auditory masking is used to determine the order that the transform coefficients are encoded, rather than to change the transform coefficients by quantizing them. Instead of coding any auditory insensitive coefficients coarsely, the EAC codec encodes such coefficients in a later stage. By using the auditory masking to govern the coding order, rather than the coding content, the EAC achieves embedded coding up to and including lossless encoding of the audio input, as all content is eventually encoded. Further, the quality of the audio becomes less sensitive to the auditory masking, as slight inaccuracies in the auditory masking simply cause certain audio coefficients to be encoded later.

Second, in the EAC, the auditory masking threshold is derived from the already encoded coefficients, and gradually refined with the embedded coder. This feature of the EAC coder is termed "implicit auditory masking." In implementing the implicit audio masking of the EAC, the most important portion of the transform coefficients, e.g., the top bitplanes, are encoded first. A preliminary auditory masking threshold is calculated based on the already coded transform coefficients. Since the decoder automatically derives the same auditory masking threshold from the coded transform coefficients, the value of the auditory masking threshold does not need to be sent to the decoder. Further, the calculated auditory masking threshold is used to govern which part of the transform coefficients is to be refined.

After the next part of the transform coefficients has been encoded, a new set of auditory masking threshold is calculated. This process repeats until a desired end criterion has been met, e.g., all transform coefficients have been encoded, a desired coding bit rate has been reached, or a desired coding quality has been reached. By deriving the auditory masking threshold from the already coded coefficients, bits normally required to encode the auditory masking threshold are saved. Consequently, the coding quality is improved, especially when the coding bit rate is low. Further, it should be noted that traditional coders carry the auditory masking threshold as a header of the bitstream. Therefore, with such traditional coders, an error in the header wipes out all subsequent coding in the bitstream. However, because the compressed bitstream generated by the EAC does not carry such a header, it is less sensitive to transmission errors, and therefore offers better error protection in a noisy channel, such as wireless transmission environment, or with streaming media over a lossy network such as the Internet.

Given the preceding discussion, the general framework of an embedded audio coder with implicit auditory masking can be summarized as follows. First, a coefficient block is separated into a set of embedded coding units (ECU), which are the smallest units in the coding carder of the coefficients. An initial auditory masking threshold is then set using either of two alternate embodiments. In one embodiment, the initial auditory masking threshold is set to a constant value. Alternately, in an embodiment used in a working example of the EAC, the initial auditory masking threshold is set using a "quiet threshold," i.e., the threshold below which a particular audio component is inaudible to a human listener. Using the initial auditory masking threshold, the coding order of the ECU is determined, and a set of high priority ECUs are encoded. Next, the auditory masking threshold is updated with the encoded ECUs. These two processes are then iterated with the auditory masking threshold implicitly determined by the encoded ECUs, thereby providing the aforementioned "implicit auditory masking."

In addition to the just described benefits, other advantages of the embedded audio coder using implicit audio masking will become apparent from the detailed description which follows hereinafter when taken in conjunction with the accompanying drawing figures.

DESCRIPTION OF THE DRAWINGS

The specific features, aspects, and advantages of the embedded audio coder using implicit audio masking will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
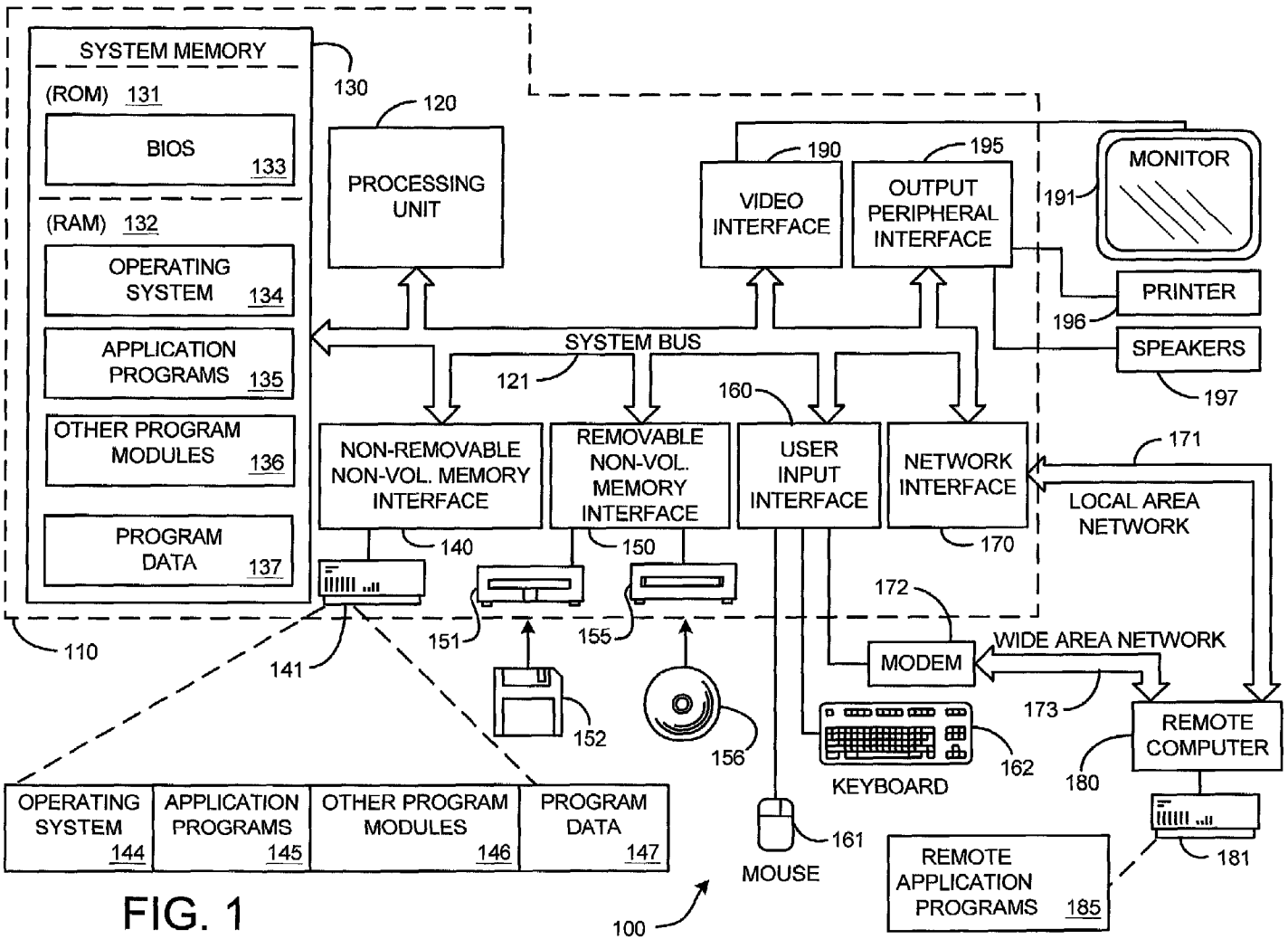
FIG. 1 is a general system diagram depicting a general-purpose computing device constituting an exemplary system for implementing an embedded audio coder with implicit auditory masking.

1.0 Exemplary Operating Environment:

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball or touch pad. Other input devices (not shown) may include a microphone, joystick, game pad, satellite dish, scanner, or the like. These and other input devices are often connected to the processing unit 120 through a user input interface 160 that is coupled to the system bus 121, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

The exemplary operating environment having now been discussed, the remaining part of this description will be devoted to a discussion of the program modules and processes embodying an embedded audio coder (EAC) with implicit auditory masking.

2.0 Introduction:

In general, the EAC is a fully scalable generic audio coder which uses a novel perceptual audio coding approach termed "implicit auditory masking" which is intermixed with a scalable entropy coding process. In particular, a system and method for embedded audio coding with implicit auditory masking employs a novel psychoacoustic audio coding scheme which has distinct advantages over conventional audio coding schemes which apply psychoacoustic masking. Specifically, unlike conventional psychoacoustic audio coding schemes, the EAC automatically derives auditory masking thresholds from previously coded coefficients, thereby eliminating any overhead associated with transmission of an auditory mask. Consequently, in accordance with the EAC described herein, auditory masking thresholds are never sent to the decoder, instead, as noted above, they are derived from the already coded coefficients. Therefore, audio compression efficiency is improved as more bits can be devoted to the coefficient coding, especially at low bit rates. In addition, unlike conventional schemes, the implicit auditory masking approach described herein produces no error sensitive header. Therefore, the bitstream is more robust for transmission over error prone channels, such as a wireless channel.

The EAC is further improved in several alternate embodiments. In particular, in one embodiment, the perceived quality of the coded audio is further improved by using the derived thresholds to control the order that the coefficients are encoded, so that those audio components that have a greater impact on perceived audio quality are encoded first. In another embodiment, the compressed bitstream generated by the EAC is fully scalable in terms of the coding bit rate, the number of audio channels, and the audio sampling rate. Finally, in still another embodiment, different psychoacoustic models are used at different stages of encoding to improve a perceptual quality of the compressed audio over a wide range of bit rates.

2.1 Conventional Psychoacoustic Masking:

Psychoacoustic masking is well known to those skilled in the art. Consequently, the basic theory behind acoustic or auditory masking will only be described in general terms below. In general, the basic theory behind psychoacoustic or auditory masking is that humans do not have the ability to hear minute differences in frequency. For example, it is very difficult to discern the difference between a 1,000 Hz signal and a signal that is 1,001 Hz. It becomes even more difficult for a human to differentiate such signals if the two signals are playing at the same time. Further, studies have shown the 1,000 Hz signal would also affect a human's ability to hear a signal that is 1,010 Hz, or 1,100 Hz, or 990 Hz. This concept is known as masking. If the 1,000 Hz signal is strong, it will mask signals at nearby frequencies, making them inaudible to the listener. In addition, there are two other types of acoustic masking which effect human auditory perception. In particular, as discussed below, both temporal masking and noise masking also effect human audio perception. These ideas are used to improve audio compression because any frequency components in the audio file which fall below a masking threshold can be discarded, as they will not be perceived by a human listener.

In particular, the human ear does not respond equally to all frequency components. The auditory system can be roughly divided into 26 "critical bands," each of which can be modeled as a band-pass filter-bank with a bandwidth on the order of 50 to 100 Hz for signals below 500 Hz, and up to 5000 Hz for signals at higher frequencies. Within each critical band, an auditory masking threshold, which is also referred as the psychoacoustic masking threshold or the threshold of the just noticeable distortion (JND), can be determined. Audio signals with energy level below the threshold will not be audible to a human listener.

Figure 2:
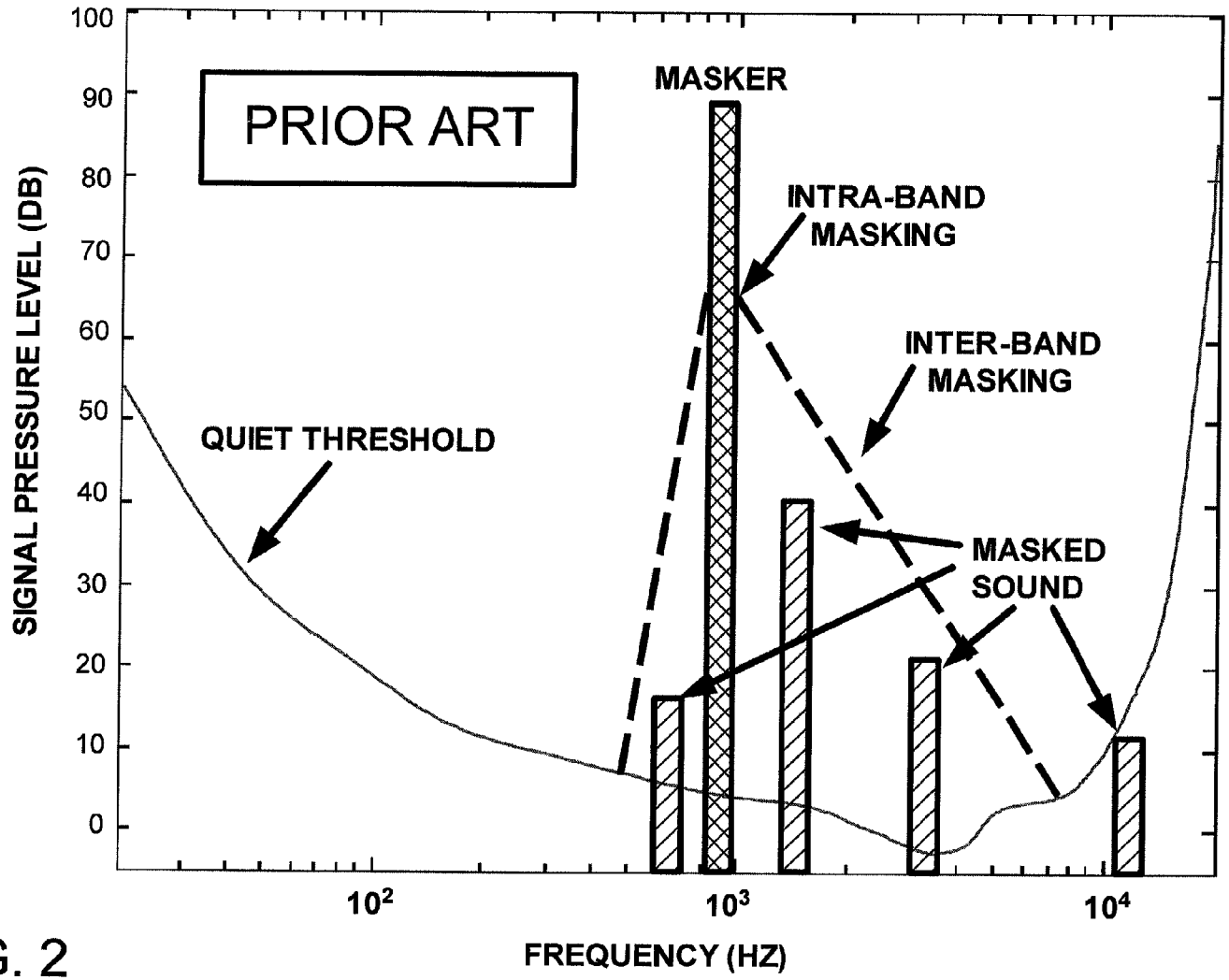
FIG. 2 is a prior art figure which provides a conventional Fletcher-Munson curve for illustrating human psychoacoustic masking.

These ideas can be further explained by examining the auditory masking threshold $TH_{i,k}$ of a critical band k at time instance i. The combined auditory masking threshold $TH_{i,k}$ can be calculated as a combination of a "quiet threshold," i.e., the threshold below which a particular audio component is inaudible to a human listener, an intra-band threshold, an inter-band threshold and a temporal masking threshold. The quiet threshold $TH_ST_k$ dictates the sensitivity of the human auditory system for a critical band k without the presence of any audio signal. It can be calculated through an equal loudness curve, such as a conventional Fletcher-Munson curve, as illustrated in FIG. 2. As can be seen from FIG. 2, the sensitivity of the human ear is approximately linear for a relatively large range (1 kHz to 8 kHz), and then drops dramatically after 10 kHz and before 500 Hz.

As further illustrated by FIG. 2, a low-level signal (the maskee) can be made inaudible by a simultaneously occurring strong signal (the masker) as long as the masker and the maskee are close enough to each other in frequency. The simultaneous masking is larger in the critical band where the masker is located, and is smaller in the neighboring critical band. The auditory masking of the same critical band is known as "intra-band masking," while the masking of the neighboring critical band is known as "inter-band masking." As is well known to those skilled in the art, the intra-band masking threshold $TH_INTRA_{i,k}$ is directly proportional to the energy of the signal in the critical band $AVE_{i,k}$, and can be calculated as illustrated by Equation 1:

$$TH_\mathrm{INTRA}_{i,k}(\mathrm{dB})=AVE_{i,k}(\mathrm{dB})-R_{fac} \qquad \text{Equation 1}$$

where $R_{fac}$ is a constant offset value.

As noted above, a strong audio signal, i.e., the masker, also masks small signals in the neighboring critical band. The inter-band masking threshold $TH_INTER_{i,k}$ that governs the masking of neighboring critical bands is illustrated by Equation 2:

$$TH_\mathrm{INTER}_{i,k}=\max(TH_{i,k-1}-R_{high},\ TH_{i,k+1}-R_{low}) \qquad \text{Equation 2}$$

where $R_{high}$ and $R_{low}$ are attenuation factors towards the high-frequency and low-frequency critical bands, respectively. As illustrated by FIG. 2, the attenuation of the masking threshold is steeper towards lower frequency bands, thus the value $R_{low}$ is larger than $R_{high}$, and the high frequency coefficients are more easily masked. The combined quiet, intra- and inter-auditory masking thresholds for a strong masker signal is illustrated in FIG. 2. The dashed line shows the auditory masking threshold created by the audio signal identified as the "Masker." Any sound signal, including compression errors and noise, below the masking threshold will not be audible by human ears.

Figure 3:
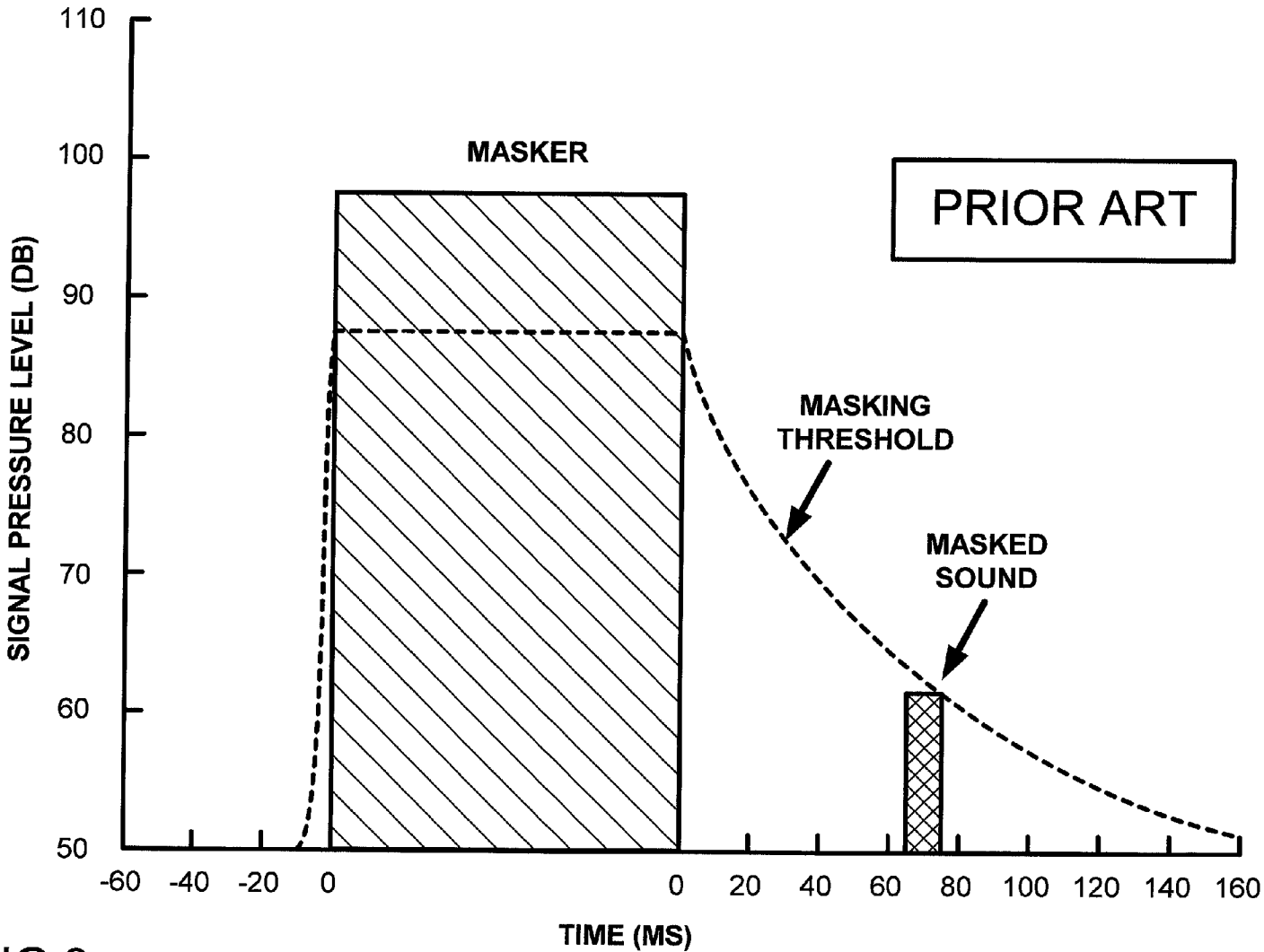
FIG. 3 is a prior art figure which provides a conventional chart for illustrating human psychoacoustic temporal masking.

Further, as is well known to those skilled in the art, according to psychoacoustic masking theory, auditory masking can also occur with an audio component immediately temporally proceeding or following a strong signal, i.e., the masker. This effect is called temporal masking. The duration within which premasking applies is less than one tenth of that of postmasking, which is on the order of 50 to 200 ms. The temporal masking threshold $TH_TIME_{i,k}$ can be calculated as illustrated by Equation 3:

$$TH_\mathrm{TIME}_{i,k}=\max(TH_{i-1,k}-R_{post},\ TH_{i+1,k}-R_{pre}) \qquad \text{Equation 3}$$

where $R_{pre}$ and $R_{post}$ are attenuation factors for the proceeding and following time intervals, respectively. A sample temporal masking threshold is illustrated in FIG. 3.

A combined auditory masking threshold is the combined maximum of the quiet, intra- and inter-band masking thresholds as illustrated by Equation 4:

$$TH_{i,k}=\max(TH_\mathrm{ST}_k,\ TH_\mathrm{INTRA}_{i,k},\ TH_\mathrm{INTER}_{i,k},\ TH_\mathrm{TIME}_{i,k}) \qquad \text{Equation 4}$$

This combined masking threshold is easily determined through an iterative calculation of Equations 2 through 4. In other words, the effect of the combined masking threshold is that if an audio signal consists of several strong maskers, the combined masking threshold is the maximum of each individual masking threshold.

2.1 System Overview:

In general, a system and method for embedded audio coding with implicit auditory masking operates to encode an audio file using auditory masking thresholds which are automatically derived from already coded coefficients. Basically, the EAC encodes an audio input, having any number of channels, as follows. First, where the audio input has more than a single channel, the audio input is provided to a multiplexer for separating the audio input into individual channel components. As described in greater detail below, each of these channel components are then transformed using either a conventional wavelet transform, or using an MLT and entropy encoded using implicit auditory masking. Note that in one embodiment, prior to entropy encoding, the transformed channel components are split into any desired number of frequency-based components, and individually entropy encoded to allow for scalability of the encoded audio file. This embodiment is described in detail below. Finally, a bitstream assembler then assembles the encoded bitstream for transmission or storage. Note that in the embodiment wherein the transformed channel components are split into frequency-based components, the bitstream assembler combines the encoded components in order of their individual contribution to a perceived audio quality.

Figure 4:
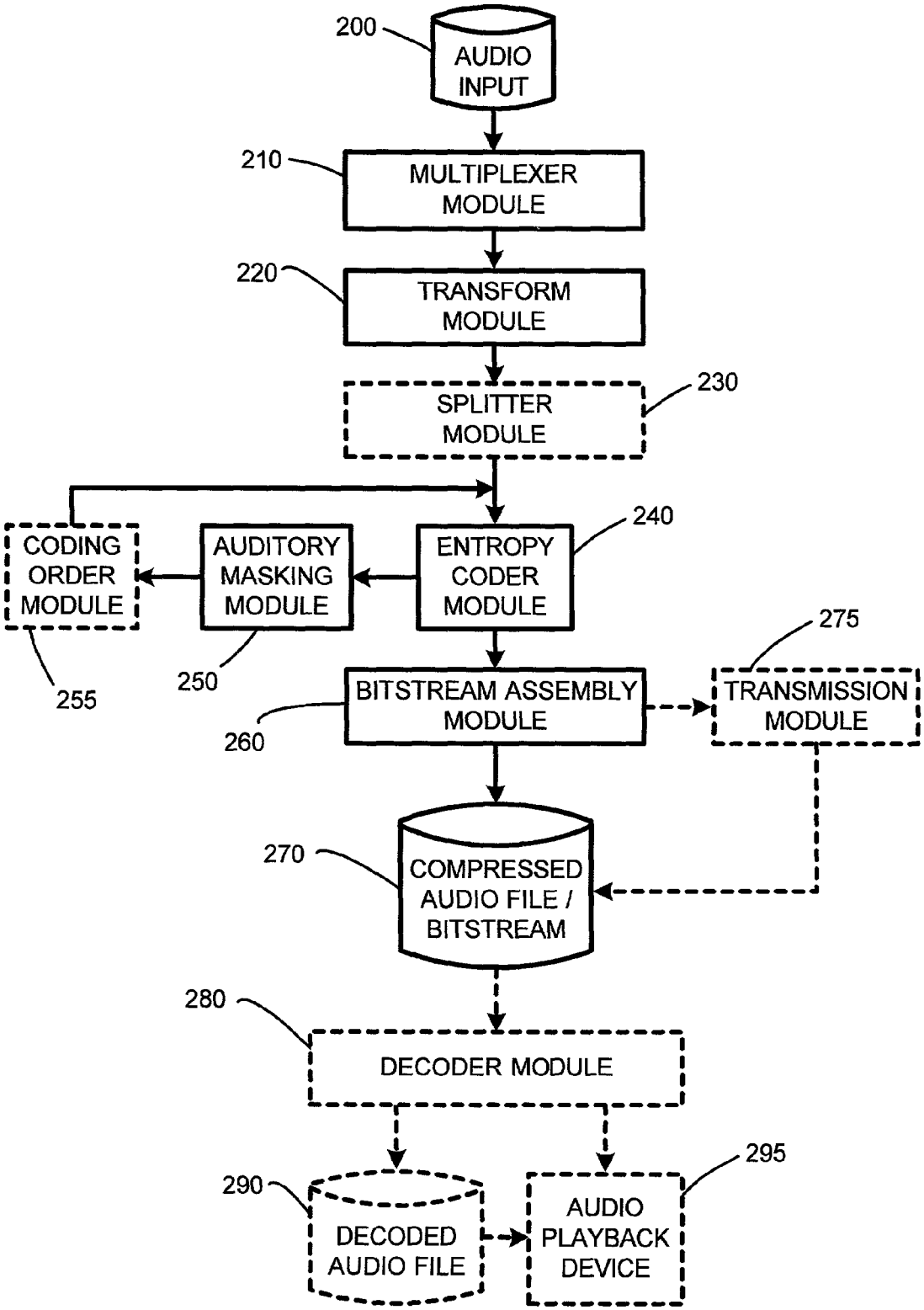
FIG. 4 illustrates an exemplary architectural diagram showing exemplary program modules for implementing an embedded audio coder with implicit auditory masking.

2.2 System Architecture:

The process summarized above is illustrated by the general system diagram of FIG. 4. In particular, the system diagram of FIG. 4 illustrates the interrelationships between program modules for implementing embedded audio coding with implicit auditory masking. It should be noted that the boxes and interconnections between boxes that are represented by broken or dashed lines in FIG. 4 represent alternate embodiments of the invention, and that any or all of these alternate embodiments, as described below, may be used in combination with other alternate embodiments that are described throughout this document.

In particular, as illustrated by FIG. 4, a system and method for embedded audio coding with implicit auditory masking begins by inputting audio from an audio file or input device 200 into a multiplexer module 210. The multiplexer module 210 uses conventional techniques to separate the audio input 200 into a number individual audio channel components, depending upon the number of audio channels in the audio input. For example, given a stereo audio input with left and right audio channels, the multiplexer module 210 separates the audio input 200 into separate L+R and L−R channel components using conventional techniques.

Next, after audio channel separation, a transform module 220 transforms each component of audio using either a conventional wavelet transform, or using a modulated lapped transform (MLT) with switching windows. Such techniques are well known to those skilled in the art. Note that in alternate embodiments, both regular MLT transforms with float calculation and reversible MLT transforms with integer calculation (for lossless compression) are used for generating the transforms. In addition, when using Float MLT, to reduce computational complexity, a scalar quantization is performed on the transformed coefficients to convert the transformed coefficients from float to integer. The size of the MLT windows used by the transformed module 220 is switchable between 2048 and 256 samples for long and short windows, respectively.

Next, in one embodiment, the transform coefficients are split into a number of "sections" by a splitter module 230. The section split operation performed by the splitter module 220 enables scalability of the audio sampling rate. Such scalability is particularly useful where different frequency responses of the decoded audio file are desired. For example, where one or more playback speakers associated with the decoder do not have a high frequency response, or where it is necessary for the decoder to save either or both computation power and time, one or more sections corresponding to particular high frequency components of the transform coefficients can be discarded. Similarly, a bandwidth aware transmission system can discard particular sections of transformed coefficients in order to optimize perceived audio playback quality as a function of available bandwidth.

Whether or not the coefficients are split as described above, each whole or sectional transform coefficient is then individually entropy encoded into an embedded bitstream by a novel sub-bitplane entropy coder 240 which employs a system of iterative implicit auditory masking. Note that the auditory masking is provided by an auditory masking module 250 which derives current auditory masking thresholds from previously coded coefficients. In addition, to improve the efficiency of the entropy coder 240, the coded coefficients are grouped into a number of consecutive windows in each timeslot. In a default setting used in a working example of the EAC using modulated lapped transforms, described in detail below, a timeslot consists of 16 long MLT windows or 128 short MLT windows. However, it should be clear to those skilled in the art that the number of windows can easily be changed.

Further, in order to improve perceived sound quality, especially at low bit rates, a coding order module 255 is used to determine coding order of the transformed coefficients. In fact, the coding order module 255 determines the coding order of coefficients based on the contribution of particular transformed coefficients to the overall perceived audio playback quality.

Finally, a bitstream assembly module 260 allocates the available coding bit rate among multiple timeslots and channels, truncates the embedded bitstream of each timeslot and channel according to the allocated bit rate, and produces a final compressed bitstream. Next, in one embodiment, a transmission module 275 uses conventional techniques to transmit the compressed bitstream over a network, such as the Internet, from a server computer to one or more remote client computers Alternately the bitstream assembly module 260 simply provides the encoded bitstream for storage 270 and later playback or transmission.

In another embodiment, a decoder module 280 then receives the compressed audio file or bitstream 270 and decodes the audio file by automatically deriving current auditory masking thresholds from previously coded coefficients, and performing a reverse transform on the encoded coefficients to recreate the encoded audio channel components. These decoded audio channel components are then either saved as a decoded audio file 290, or provided to a conventional playback device 295 for audio playback.

3.0 Operation Overview:

The above-described program modules are employed in an embedded audio coder with implicit auditory masking for psychoacoustic coding of audio files. This process is depicted in the flow diagram of FIG. 11 following a detailed operational discussion of exemplary methods for implementing the aforementioned programs modules.

Figure 5:
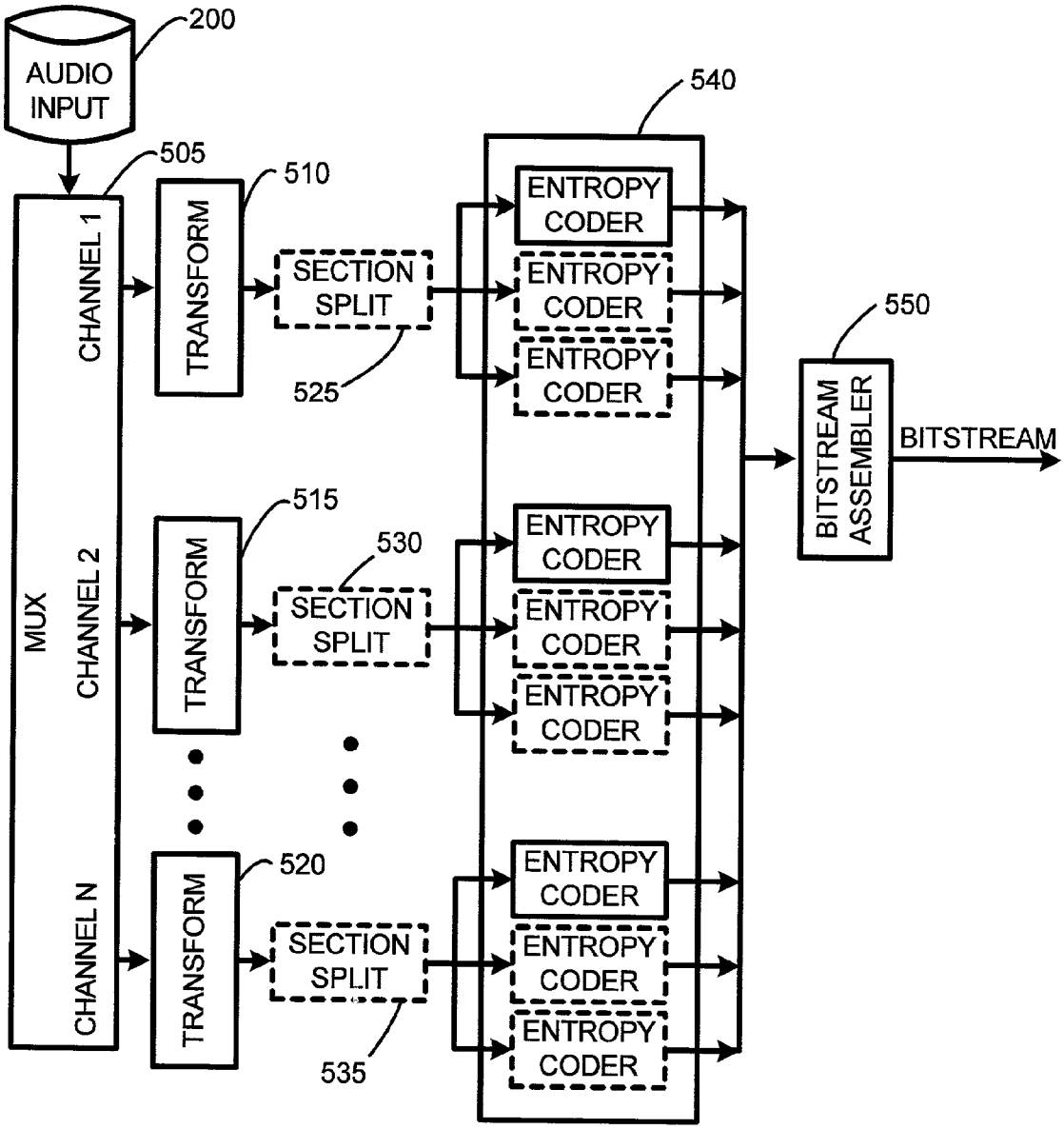
FIG. 5 illustrates a basic framework for implementing an embedded audio coder with implicit auditory masking.

3.1 Embedded Audio Coder (EAC):

As noted above, a system and method for embedded audio coding with implicit auditory masking operates to encode an audio file using auditory masking thresholds which are automatically derived from already coded coefficients. Basically, the EAC encodes an audio input, having any number of channels, as illustrated by the general framework of the functional block diagram of FIG. 5. The general architectural framework of the EAC is illustrated in FIG. 5. FIG. 5 illustrates the audio input 200 being provided to a multiplexer 505 for separating out any number of audio channel components as described above. These audio channel components are then transformed by either a wavelet transform or an MLT 510, 515 and 520. The transformed coefficients are then optionally split 525, 530, and 535, to allow for audio signal scalability. Each of the transformed, and potentially split, coefficients are then provided to an entropy coder 540 for generation of an encoded bitstream which is assembled 550 and provided for storage, transmission, or playback as described in further detail below.

In particular, using a stereo audio input as an example, the audio input is first provided to a multiplexer (MUX) and separated into L+R and L−R channel components. Each component is then encoded separately prior to combining the encoded components into a bitstream for transmission or storage. After channel separation, each component of the audio input is then transformed by a using either a conventional wavelet transform, or a modulated lapped transform (MLT) with switching windows. Both regular MLT with float calculation, and reversible MLT transform with integer calculation, are used in alternate embodiments. Note that use of the reversible MLT transform allows for lossless encoding of the audio input. If float MLT is used, a scalar quantization is performed on the transformed coefficients to convert the transform coefficients from float to integer. The size of the MLT window is switchable between 2048 and 256 samples, for long and short windows, respectively.

In one embodiment, in order to provide compression scalability as a function of perceived audio quality, the transform coefficients are split into a number of sections. Table 1 provides an example of MLT coefficient splitting that was used in a working example of the EAC. In particular, as illustrated by Table 1, the MLT coefficients were split into three sections. It should be appreciated by those skilled in the art that the coefficients can be split into more or less sections in order to provide for either more or less scalability of the compressed audio input. This section split operation enables the scalability of the audio sampling rate because the section corresponding to particular frequency components can be thrown away, as desired. For example, where it is known that playback of a decoded audio file will be done on a playback device or speaker having little or no high frequency response, both computation power and time can be saved by discarding the section corresponding to the highest frequency components, i.e., Section 3 as illustrated by Table 1. Note that discarding one or more sections of the split coefficients reduces the size of a compressed audio file that is compressed using the EAC.

TABLE 1

Exemplary MLT Coefficient Splitting.

| | Section 1 (0 to 0.25π) | Section 2 (0.25π to 0.50π) | Section 3 (0.50π to π) |
|---|---|---|---|
| Window size 2048 | 0–511 | 512–1027 | 1028–2047 |
| Window size 256 | 0–63 | 64–127 | 128–255 |

Each section of the transform coefficients is then entropy encoded into an embedded bitstream using a novel sub-bitplane entropy coder with implicit auditory masking as described in further detail below. Note that the bitstream can be truncated and reassembled at a later time for storage or playback. To improve the efficiency of the entropy coder, transform coefficients are grouped into a number of consecutive windows in each timeslot. In a default setting in a working example of the EAC using MLT's, a timeslot consisting of 16 long MLT windows or 128 short MLT windows was used. Clearly, it should be appreciated by those skilled in the art that the number of long and short MLT windows can be easily changed to provide a desired coding performance.

Finally, a bitstream assembler allocates the available coding bitrate among multiple timeslots and channels, truncates the embedded bitstream of each timeslot and channel according to the allocated bitrate, and produces the final compressed bitstream.

3.1.1 Implicit Auditory Masking:

Conventional psychoacoustic audio encoders calculate an auditory masking threshold based on the input audio signal. This masking threshold is then encoded as a part of the compressed bitstream, and is used to control the quantization of the transform coefficients. In contrast, the EAC described herein applies auditory masking in a substantially different way for encoding an audio input.

First, in one embodiment, the auditory masking employed by the EAC is used to determine the order that the transform coefficients are encoded, rather than to change the transform coefficients (by quantizing them). Instead of coding the auditory insensitive coefficient coarsely, the EAC codec encodes such coefficients in a later stage. By using the auditory masking to govern the coding order, rather than the coding content, the EAC can achieve embedded coding all the way to lossless, as all content is eventually encoded. Further, the quality of the audio becomes less sensitive to the auditory masking, as slight inaccuracies in the auditory masking simply cause certain audio coefficients to be encoded later.

Figure 6:
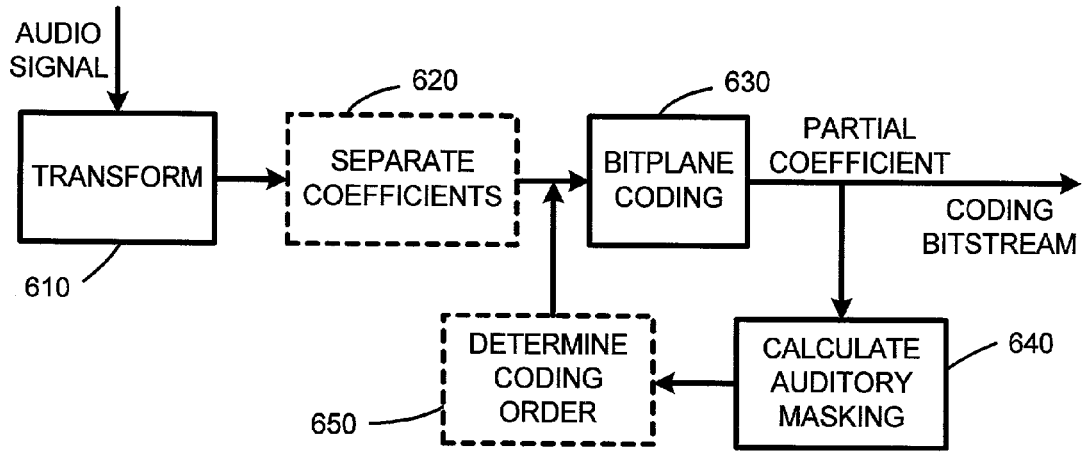
FIG. 6 illustrates a flow diagram for implementing implicit auditory masking in an entropy encoder for use in embedded coding of an audio file with implicit auditory masking.

Second, in the EAC, the auditory masking threshold is derived from the already encoded coefficients, and gradually iteratively refined by the embedded coder. This feature of the EAC coder is called "implicit auditory masking." The general system flow of an embedded audio coder with implicit auditory masking is illustrated by FIG. 6. In particular, as illustrated by FIG. 6, the audio signal is first transformed 610. The transform coefficients are then optionally split or separated 620. The coefficients, split or whole are then bitplane encoded 630 using an iterative feedback of previously calculated masking thresholds 640. Further, where the transformed coefficients are split 620, an optimal coding order is determined 650 for the purpose of coding those coefficients having a greater impact on perceived sound quality earlier than those coefficients that have a lesser impact on perceived sound quality. These concepts are discussed in greater detain in the following sections.

In particular, the most important portion of the transform coefficients, i.e., the top bitplanes, are first encoded by the entropy coder. Using the EAC, a preliminary auditory masking threshold is then calculated based on the already coded transform coefficients. Since the decoder derives the same auditory masking thresholds from the coded transform coefficients, the value of the auditory masking threshold do not need to be provided to the decoder. The calculated auditory masking threshold is used to govern which part of the transform coefficients is to be refined.

After the next part of the transform coefficients have been encoded, a new set of auditory masking thresholds is calculated. This process repeats until a certain end criterion has been met, e.g., all transform coefficients have been encoded, a desired coding bitrate has been reached, or a desired coding quality has been reached. By deriving the auditory masking thresholds from the already coded coefficients, bits normally required to encode the auditory masking threshold are saved. Consequently, the coding quality can be improved by allocating more bits to the encoded signal, rather than to masking information, especially when the coding bitrate is low. It should be noted that traditional psychoacoustic coders carry the auditory masking threshold as a header of the bitstream. Consequently, any error in the header wipes out all subsequently coding coefficients in the bitstream.

Since the EAC compressed bitstream does not carry such a header, it is less sensitive to potential transmission errors, and therefore offers better error protection in a noisy channel, such as in a wireless transmission environment or over a lossy network such as the Internet.

Figure 7:
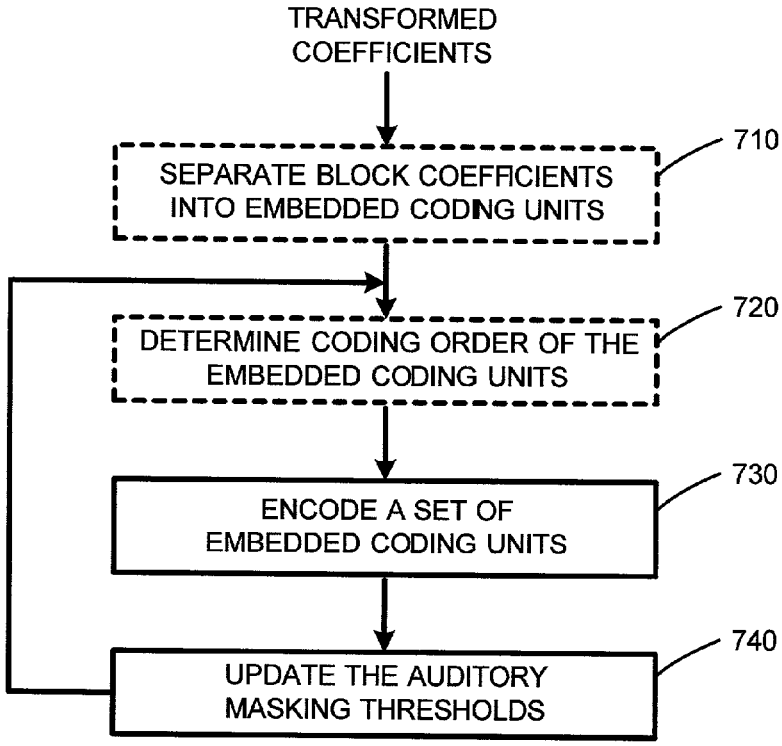
FIG. 7 illustrates an operational flow diagram for implementing implicit auditory masking for use in embedded coding of an audio file.

The general framework of an embedded audio coder with implicit auditory masking is further illustrated by FIG. 7. In particular, as illustrated by FIG. 7, in one embodiment, the coefficient block, i.e., each transformed coefficient, is first optionally separated 710 into a set of embedded coding units (ECU). Note that these ECU's are the smallest units available for reordering the coefficient coding for optimizing perceived sound quality as a function of bit rate, thereby allowing for scalability of the encoded audio file. Next, an initial auditory masking threshold is then calculated, e.g., by using either the aforementioned quiet threshold, or by simply setting the initial auditory masking threshold to a predetermined constant. Using this initial auditory masking threshold, the coding order of the ECU is determined 720, and a set of high priority ECUs are encoded 730. Next, the auditory masking threshold is implicitly updated with the encoded ECUs 740, hence the name implicit auditory masking. The process of 730 and 740 then iterates: the newly updated auditory masking threshold determines a new coding order of the ECU, and a next set of high priority ECUs are encoded 730. The encoded ECUs further refines the auditory masking threshold. Specific details for implementing one embodiment of implicit auditory masking are provided in the following section.

Figure 8:
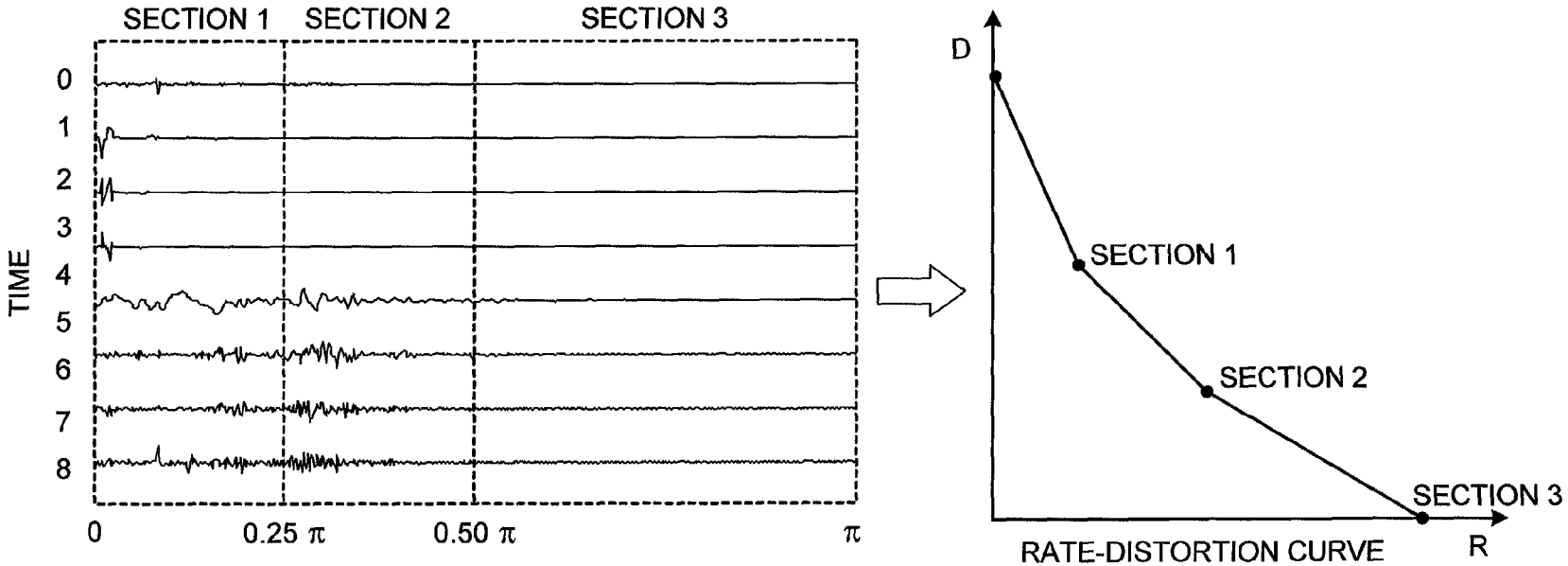
FIG. 8 illustrates a generic input and output of an embedded audio coder with implicit auditory masking, showing sectionalized transform coefficients and a corresponding rate-distortion curve for use in embedded coding of an audio file with implicit auditory masking.

FIG. 8 represents an exemplary rate-distortion curve produced for a segment of data using 1 or more sections of encoded coefficients. Note that the input of the embedded audio coder is a block of transformed and quantized coefficients of one section. As can be seen from the rate distortion curve of FIG. 8, the bit-rate increases while the perceptual distortion decreases as more coefficient sections are encoded and added to the bitstream. For example, in a working example of the EAC using MLT's, for audio sampled at 44.1 kHz, 0.74 seconds of audio samples are grouped into a block for entropy coding. Note that because there are two MLT windows, of size 2048 and 256, this time period corresponds to 16 frames of 2048 windowed MLT coefficients, or 128 frames of 256 windowed MLT coefficients. Again, while each MLT window is optionally separated into three sections, as shown in Table 1, it should be noted that the coefficients can be divided into either more or less sections, as desired for scalability of the encoded audio file. The output of the embedded audio coder is a compressed embedded bitstream that can be truncated anywhere in later stage, and a rate-distortion (R-D) performance curve which indicates the performance at the truncation point.

3.1.2 Context Adaptive Entropy Coding:

At each coding time instance, the coefficients are further divided into a number of critical bands, with the total number of critical bands depending upon the psychoacoustic model used. In a working example of the EAC, 25 critical bands corresponding to the critical bands in the human auditory system were used. Given the number of critical bands, let i index the time instance, j index the frequency component, and k index the critical band. Further, let $x_{i,j}$ be the quantized coefficient at time instance i, frequency j, and $s_{i,k}$ be the critical band k at time instance i. The embedded coder then encodes the quantized audio coefficient bit by bit. Therefore, each quantized coefficient is represented in the binary form as illustrated by Equation 5:

$$[\pm b_{L-1} b_{L-2} \ldots b_0] \qquad \text{Equation 5}$$

where $b_{L-1}$ is the most significant bit (MSB), and $b_0$ is the least significant bit (LSB), ± is the sign of the coefficient. A group of bits of the same significance from different coefficients forms a bitplane. For example, bit $b_{L-1}$ of all coefficients in the critical band $s_{i,k}$ forms the most significant (L−1) bitplane of the critical band. By coding the more significant bits of all coefficients first, and coding the less significant bits later, the output compressed bitstream is said to have the embedding property, as a lower rate bitstream can be obtained by truncating a higher rate bitstream, which results in a partial decoding of all coefficients.

Figure 9:
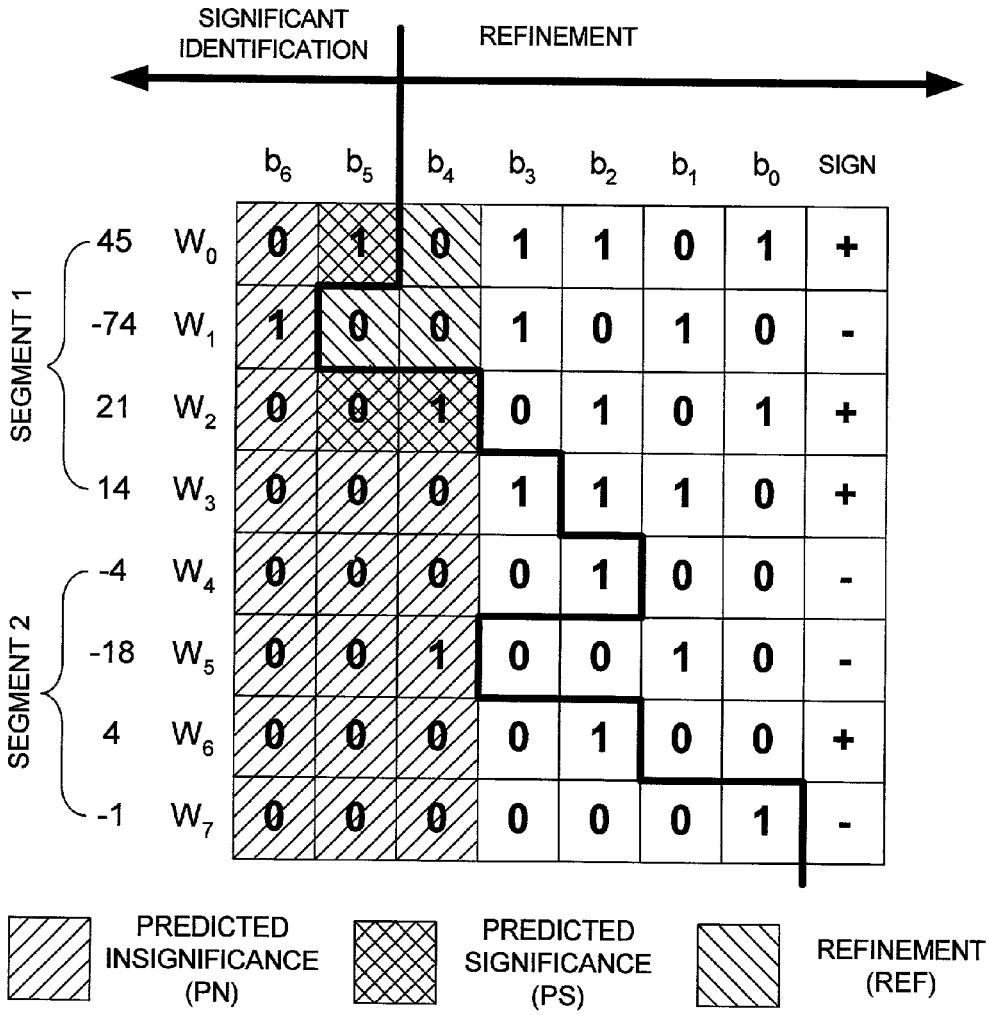
FIG. 9 illustrates an exemplary bit array for embedded coding of an audio file using an embedded audio coder with implicit auditory masking.

A sample bit array is shown in FIG. 9. Since the quantized coefficients in the EAC are actually arranged in a 2-D array indexed by time instance i and frequency j, the actual bit array is 3-D. However, the 2-D array illustrated by FIG. 9 can be considered as a slice of the 3D bit array at a particular time instance. Further, a drawing representation of the 3-D bit array would not serve to better explain the concepts embodied herein. Note that the bit array represents quantized audio coefficients and consists of both the bits and sign of the coefficient. Further, the bits in the bit array are statistically different.

Therefore, where $b_M$ is a bit in a coefficient x which is to be encoded, if all more significant bits in the same coefficient x are '0's, the coefficient x is said to be insignificant (because if the bitstream is terminated at that point, coefficient x will be reconstructed as zero), and the current bit $b_M$ is to be encoded in the mode of "significant identification". Otherwise, the coefficient is said to be significant, and the bit $b_M$ is to be encoded in the mode of "refinement." A distinction is made between "significant identification" and "refinement" bits because the significant identification bit has a very high probability of '0', while the refinement bit is usually equally distributed between '0' and '1'. Further, the sign of the coefficient needs to be encoded immediately after the coefficient turns significant, i.e., a first non-zero bit in the coefficient is encoded. For the bit array illustrated in FIG. 9, the significant identification and the refinement bits are shown with different shading. For a critical band $s_{i,k}$, it is "insignificant" if all the coefficients in the critical band are insignificant. Conversely, it becomes significant if at least one coefficient in that critical band is significant.

Note that the significant identification bits, refinement bits and signs are not statistically equal among themselves either. For example, if a quantized coefficient $x_{i,j}$ is of large magnitude, its time and frequency neighbor coefficients may also be of large magnitude. Additionally, the harmonics of the coefficient (at double and/or triple frequency points) may also be of large magnitude. To account for such statistical differences, the EAC entropy encodes the significant identification bits, refinement bits and signs with context, each of which is a number derived from already coded coefficient in the neighborhood of the current coefficient. It should be noted that entropy encoding the significant identification bits, refinement bits and signs with context is a conventional coding technique commonly referred to as context adaptive entropy coding, and is frequently used in modern media coding systems, such as in the well known JPEG 2000 system. Consequently, such coding will not be described in significant detail herein.

The context for the significant identification, refinement and signs is discussed below. The context for the refinement bits and signs is described first, followed by a discussion of the significant identification bits. The context of the refinement coding bits depends on the significant statuses of the immediate four coefficients, which for coefficient $x_{i,j}$ are the coefficients with the same frequency component but at the proceeding ($x_{i-1,j}$) and following time instance ($x_{i+1,j}$), and coefficients at the same time instance but with a lower ($x_{i,j-1}$) and higher ($x_{i,j+1}$) frequency components. Details of the refinement context are provided in Table 2.

TABLE 2

Context for the "Refinement Bit."

| Context | Description |
|---|---|
| 10 | Current refinement bit is the first bit after significant identification and there is at least one significant coefficient in the immediate four neighbors |
| 11 | Current refinement bit is the first bit after significant identification and there is no significant coefficient in the immediate four neighbors |
| 12 | Current refinement bit is at least two bits away from significant identification. |

To determine the context for sign coding, a horizontal sign count h and a vertical sign count v are calculated. The two neighboring coefficients ($x_{i,j-1}$) and ($x_{i,j-1}$), that are at the same time instance but with different frequency components, are known as the horizontal neighbors, and the two coefficients ($x_{i-1,j}$) and ($x_{i+1,j}$), that are at the same frequency components but with different time instance, are known as "vertical neighbors." The horizontal and vertical sign counts are calculated in accordance with Table 3.

TABLE 3

Calculation of "Sign Count."

| Sign count: h, v | Description |
|---|---|
| −1 | Both horizontal/vertical coefficients are negative significant; or one coefficient is negative significant, and the other is insignificant. |
| 0 | Both horizontal/vertical coefficients are insignificant; or one coefficient is positive significant, and the other is negative significant. |
| 1 | Both horizontal/vertical coefficients are positive significant; or one coefficient is positive significant, and the other is insignificant. |

In addition, an expected sign and a context of sign coding is calculated in accordance with Table 4.

TABLE 4

Expected Sign and Context for Sign Coding.

| | | | | | | | | | | |
|---|---|---|---|---|---|---|---|---|---|---|
| Sign count | H | −1 | −1 | −1 | 0 | 0 | 0 | 1 | 1 | 1 |
| | V | −1 | 0 | 1 | −1 | 0 | 1 | −1 | 0 | 1 |
| Expected sign | | − | − | + | − | + | + | − | + | + |
| Context | | 13 | 14 | 15 | 16 | 17 | 16 | 15 | 14 | 13 |

In general, the refinement and sign coding generate about 20% of the total output compressed bitstream, while the remainder of the compressed bitstream is comprised of information of the significant identification bits. The context for the refinement and sign coding of the EAC are designed with reference to the context used in the well known JPEG 2000 standard. However, in contrast to the JPEG 2000 standard, the significant identification context is substantially different than that described by the JPEG 2000 standard.

Figure 10:
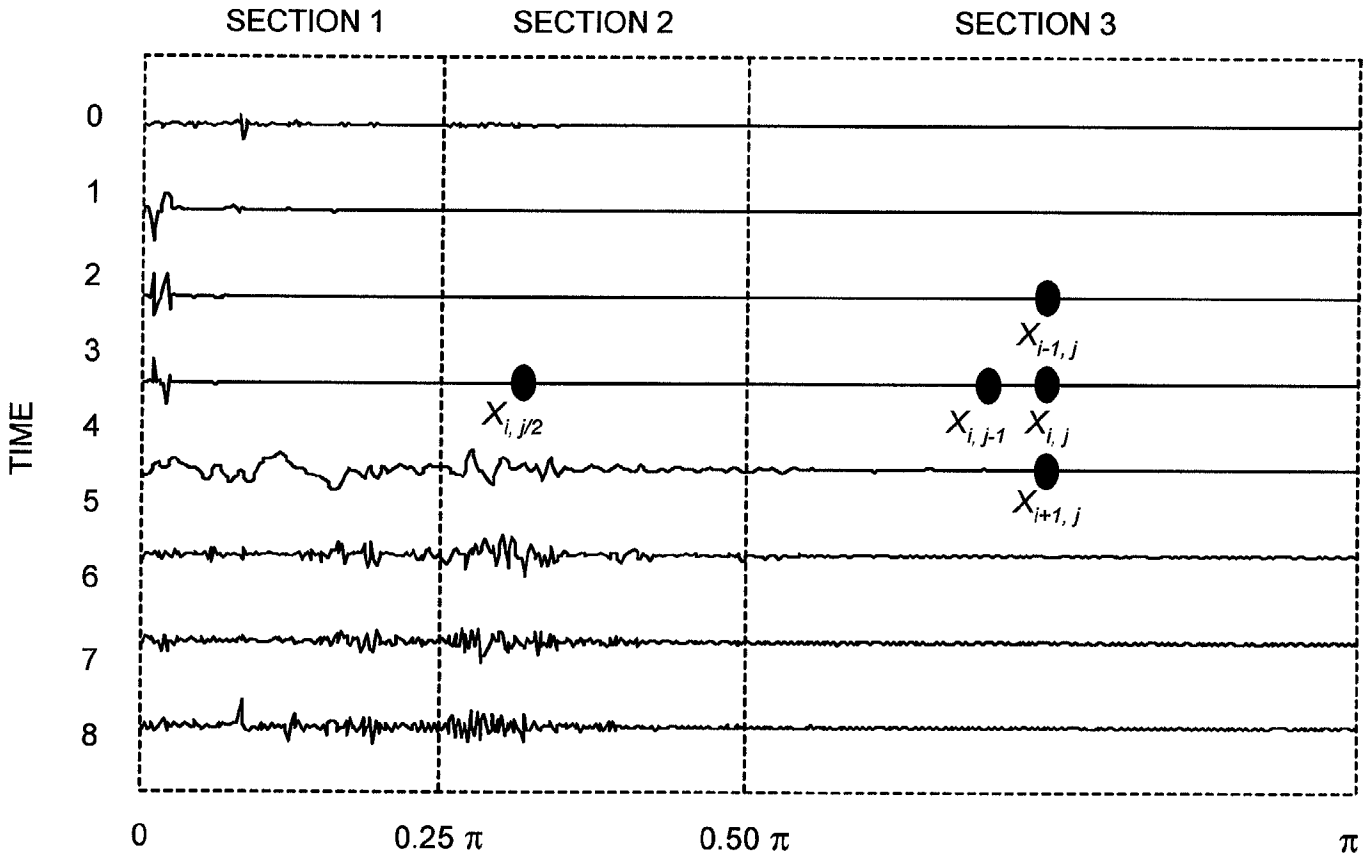
FIG. 10 illustrates a context for significant identification bits with respect to a graph which illustrates sectionalized transform coefficients as a function of time for use in embedded coding of an audio file with implicit auditory masking.

In particular, to calculate the context of the significant identification bit, not only are the significant statuses of the four neighbor coefficients used, but the significant statuses of the half harmonics and the window split are also used. Specifically, the components used for the calculation of the context of significant identification are illustrated in FIG. 10. These components are described as follows:

1. Significant status of the coefficient at the same time instance but with a lower frequency component ($x_{i,j-1}$).
2. Significant status of the coefficient at the previous time instance ($x_{i-1,j}$).
3. Significant status of the coefficient at the following time instance ($x_{i+1,j}$).
4. Significant status of the coefficient at the half harmonic frequency point of the current time instance ($x_{i,j/2}$).
5. If either coefficient from 1–4 is not in the same section with the current coefficient, it is considered as insignificant.
6. The current MLT window size (2048 or 256).

Rule 5 ensures that the encoding of the current section does not rely on content of other sections, and thus the coding bitstream of the current section can be truncated at any point. The use of the half harmonic frequency component in determining the context of the significant identification appears to be unique in audio compression. The use of the half harmonic is incorporated into the EAC in the context of audio compression because most sound producing instrument produce harmonics of a base tone, and it is the harmonics that distinguish one musical instrument from another. The actual context used for the significant identification is illustrated in Table 5.

TABLE 5

Context for Significant Identification.

| | | Significant Status of Coefficient | | | |
|---|---|---|---|---|---|
| Context | MLT Window Size | ($X_{i,j-1}$) | ($X_{i-1,j}$) | ($X_{i+1,j}$) | ($X_{i,j/2}$) |
| 0 | 2048 | N | N | N | N |
| 1 | 2048 | * | S | * | * |
| 2 | 2048 | S | N | * | * |
| 3 | 2048 | N | N | S | * |
| 4 | 2048 | N | N | N | S |
| 5 | 256 | N | N | N | N |
| 6 | 256 | * | S | * | * |
| 7 | 256 | S | N | * | * |
| 8 | 256 | N | N | S | * |
| 9 | 256 | N | N | N | S |

Note:
S: Significant; N: Non-Significant; *: Arbitrary)

Note that the context differentiates bits with different statistical properties and greatly improves the compression efficiency. However, to calculate the contest for a significant identification, refinement or sign coding operation, the significant statuses of the four neighbor coefficients need to be determined. Unfortunately, this determination is computationally expensive. Consequently, in an alternate embodiment, the determination is speeded up by using a lookup table. In particular, in a working example of the EAC codec, the following storage facilities and lookup tables are used:

1. Neighborhood Context $c_{i,j}$: For each quantized coefficient $x_{ij}$, a neighborhood context $c_{i,j}$ is maintained, where $c_{i,j}$ is represented by a 16 bit mask that occupies two bytes. Each bit of the mask represents the significant status and/or sign of one neighbor coefficient, and it can be expressed as illustrated by Table 6:

TABLE 6

| Neighborhood Context. | |
|---|---|
| Bit of Neighborhood Context | Bit is '1' if: |
| 0 | $(X_{i,j-1})$ is significant |
| 1 | $(X_{i,j+1})$ is significant |
| 2 | $(X_{i-1,j})$ is significant |
| 3 | $(X_{i+1,j})$ is significant |
| 4 | $(X_{i,j-1})$ is positive |
| 5 | $(X_{i,j+1})$ is positive |
| 6 | $(X_{i-1,j})$ is positive |
| 7 | $(X_{i+1,j})$ is positive |
| 8 | $(X_{i/2,j-1})$ is significant |

At first, the array of the neighborhood context is initialized to all zero, as all coefficients, and thus their neighbors, are insignificant. During entropy coding process, as soon as one coefficient becomes significant, the neighborhood contexts of its neighbor coefficients are updated. With the neighborhood context, instead of polling the significant statuses of four neighbor coefficients for each bit operation of significant identification, refinement and sign coding, six neighborhood context update operations (four for each of the four neighbors, and two for the half harmonics) are applied per significant coefficient.

2. Lookup table: A lookup table is used to convert neighborhood context into context for significance identification, refinement and sign coding. Specifically, a 32-entry (5 bit) lookup table is used to convert the neighborhood context into the context for significance identification. A 256-entry (8 bit) lookup table is used to convert the neighborhood context into the predicted sign and context for sign coding. The derivation of the refinement context is straightforward, and does not need lookup table.

3.1.3 Embedded Coding Unit and Auditory Threshold Update Interval:

Given the preceding discussion of the underlying entropy coder used in the EAC, the application of implicit auditory masking for encoding the audio coefficients can now be described in detail. Note that the basic principles of the implicit auditory masking operation were described above with reference to FIG. 6 and FIG. 7. The primary operations of implicit auditory masking include embedded encoding of a set of coefficient bits, calculating auditory masking thresholds from coded coefficients, and using the auditory masking thresholds to determine the coding order of the remaining coefficient bits. Note that while this process can be performed on an individual bit basis, it is very computationally expensive. Therefore, because in comparison to traditional embedded coding schemes, the extra steps involved in the implicit auditory masking are bit reordering and auditory masking threshold updating, two concepts are introduced:

1. Embedded Coding Unit (ECU): The ECU is the minimum unit involved in the reordering operation. Since the auditory masking threshold is uniform within a critical band, it is natural that an ECU in the EAC codec should be formed by a group of bits of the same critical band. In fact, according to the EAC described herein, the ECU of the current EAC codec is a sub-bitplane of a critical band. In a working example of the EAC, the bitplane in a critical band is divided into three sub-bitplanes, hereafter referred to as the "predicted significance" (PS), the "refinement" (REF), and the "predicted insignificance" (PN) sub-bitplanes. The PS sub-bitplane consists of bits of coefficients that are insignificant but have at least one significant neighbor. The REF sub-bitplane consists of bits of coefficients that are significant and are to be coded in refinement mode. The PN sub-bitplane consists of bits of coefficients that are insignificant with no significant neighbors. This division again follows the well known JPEG 2000 standard. For example, the sample bit-array of the aforementioned FIG. 9, illustrates each of the aforementioned sub-bitplane types with different shading for the first 3 bitplanes of the critical band.

To mark the identity of the sub-bitplane, the critical band where the sub-bitplane bits are located is used along with the identification (ID) of the sub-bitplane in the form of a fractional number. The integral part of the ID is just the bitplane index, while the fraction part is assigned according to the sub-bitplane class. In a working example of the EAC, the PS, REF and PN sub-bitplanes are assigned the numbers 0.875, 0.125 and 0.0, respectively. For example, the ID of the PS sub-bitplane of bitplane 7 is 7.875. The fraction value is designed according to the rate-distortion contribution of each sub-bitplane class. Within each critical band, the sub-bitplanes are encoded according to the descending order of its ID value. The first sub-bitplane to be encoded in a critical band is always a PN sub-bitplane, as all coefficients are insignificant at first.

2. Auditory masking threshold update interval: Because inaccuracy of the masking threshold only causes a slight non-optimal coding order of the critical band, its impact on compression performance is minimal. Consequently, it is computationally more efficient to update the auditory masking threshold infrequently, only upon regular check points. However, either method can be used in accordance with the EAC described herein.

3.2 Process Operation:

To enable the implicit auditory masking operation, two important properties are assigned to each critical band: a "masking threshold" and a "progress indicator." The masking threshold records the auditory masking threshold along the coding process, and the progress indicator records the ID of the top sub-bitplane of each critical band to be encoded. Consequently, one of the primary calculations performed by the EAC with implicit auditory masking is to calculate an instantaneous auditory masking threshold from the already encoded coefficients, and select the sub-bitplane to be encoded according to the instantaneous masking threshold.

As noted above, the program modules described in Section 2.0 with reference to FIG. 4 are employed to automatically encode an audio input with an entropy encoder using implicit auditory masking. This process is depicted in the flow diagram of FIG. 11. It should be noted that the boxes and interconnections between boxes that are represented by broken or dashed lines in FIG. 11 represent alternate embodiments of the present invention, and that any or all of these alternate embodiments, as described below, may be used in combination.

Figure 11:
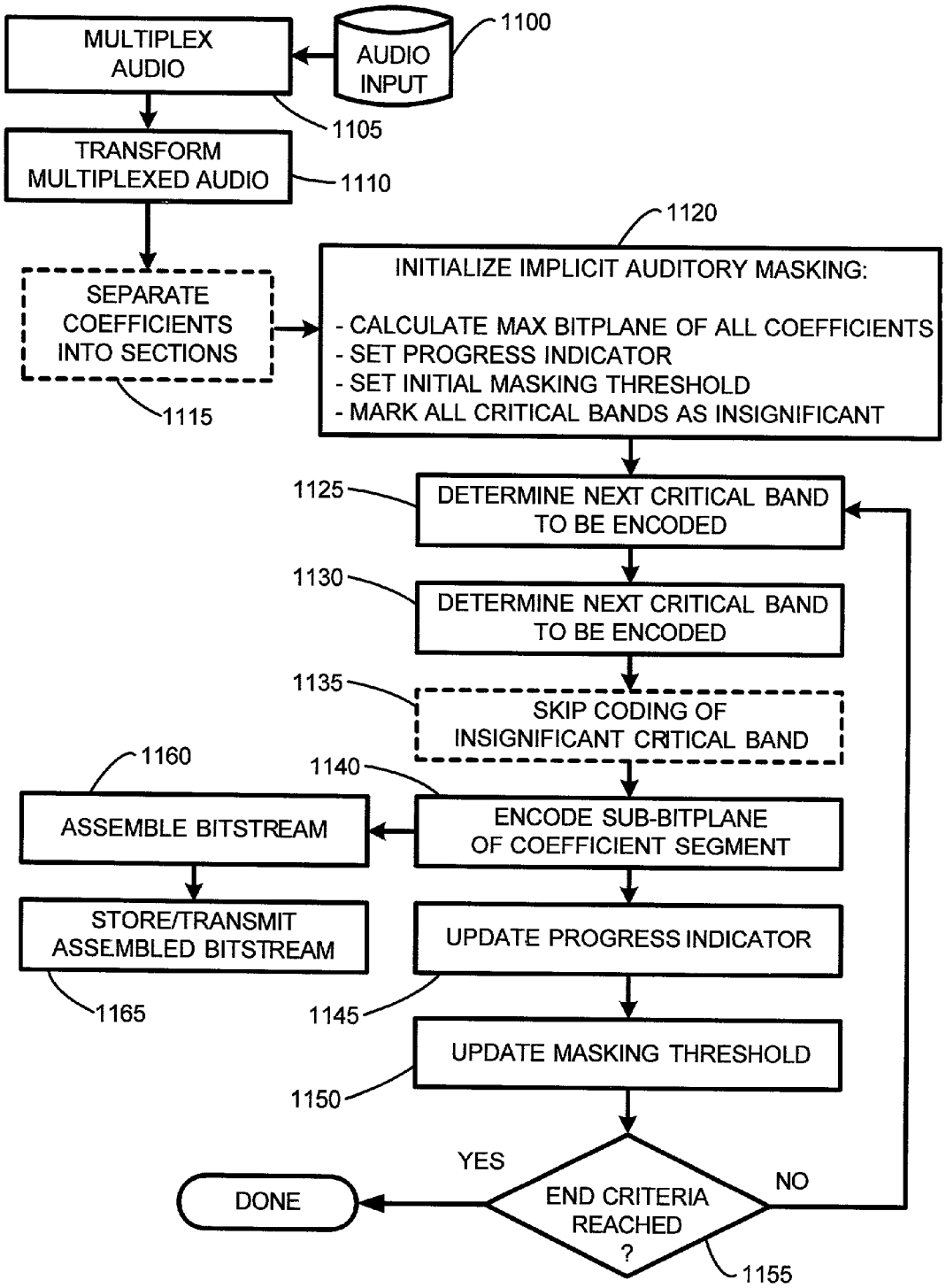
FIG. 11 illustrates an exemplary system flow diagram for implementing an embedded audio coder with implicit auditory masking.

Referring now to FIG. 11 in combination with FIG. 4, the process can be is generally described as a series of seven steps, six of which are iterated after an initialization for entropy encoding an audio signal using implicit auditory masking. In particular, as illustrated by FIG. 11, an audio input 1100 is provided to a multiplexer 1105 for channel separation as described above. The multiplexed audio is then transformed using either wavelet transforms or MLT's 1110, again, as described above. Next, in an alternate embodiment, the transformed coefficients are separated into sections 1115, again, as described above.

Next, the coefficients are entropy encoded. The first step in the entropy encoding with implicit auditory masking is an initialization step 1120. To achieve this initialization, a maximum bitplane L of all coefficients is first calculated. Next, progress indicators of all coefficients or coefficient segments are set to (L−1), which is the ID of the PN sub-bitplane of bitplane L−1. Next, the initialization step sets the initial masking threshold according to the aforementioned quiet threshold of the critical band. Finally, the initialization is completed by marking all critical bands as insignificant.

The second step in the entropy encoding with implicit auditory masking involves finding the next critical band to be encoded 1125. This is accomplished as follows. For each critical band, a "gap" is calculated between its progress indicator and the masking threshold. The smallest gaps among all segments are defined as the "current gap." Note that the value of the current gap can be negative, which simply means that the coefficients with signal energy level below the auditory masking threshold are encoded. The critical bands with a gap value the same as the current gap are chosen to be encoded. Because the masking threshold is monotonically increasing, and the progress indicator is monotonically decreasing, the current gap shrinks every iteration.

The third step in the entropy encoding with implicit auditory masking is an optional step which involves skipping the encoding of particular critical bands 1135. In particular, for the chosen insignificant critical band, a single status bit is encoded indicating whether the critical band turns significant after the coding of the current bitplane. While this step is optional, as noted above, it serves to speed up the coding/decoding operation significantly, as large area of zero-bits are skipped.

The fourth step in the entropy encoding with implicit auditory masking involves encoding the sub-bitplane of the coefficient or coefficient segment 1140. Individual bits in the chosen significant critical band are encoded through a context sensitive entropy coder.

The fifth step in the entropy encoding with implicit auditory masking involves simply updating a progress indicator 1145. In particular, the progress indicator is simply updated with the ID of the next sub-bitplane to be encoded.

The sixth step in the entropy encoding with implicit auditory masking involves updating the masking threshold 1150. In particular, if the check point is reached, the masking threshold of each critical band is updated based on the already coded audio coefficients.

Finally, the seventh step in the entropy encoding with implicit auditory masking involves checking to see if a particular end criteria has been met 1155. In particular, iteratively repeating steps two through seven, i.e., 1125 through 1155, respectively, are iteratively repeated until a certain end criterion is reached. For example, the end criterion can be that a desired coding bitrate has been reached, a desired coding quality has been reached, or all bits in all coefficient segments have been encoded.

3.2.1 Repeated Updating of the Auditory Masking Threshold:

Except for the sixth step discussed above, i.e., updating the masking threshold (Box 1150), each of the other processing steps described above in Section 3.2 are either trivial in computational complexity, or can be found in a conventional sub-bitplane entropy coder. Therefore, it can be seen that the added computational complexity introduced by the EAC with implicit auditory masking is attributable to the repeated updating of the auditory masking threshold. The following section describes in detail the steps used in a working example of the EAC for calculating the instantaneous auditory masking threshold. Further, methods for simplifying these calculations are discussed. Again since inaccuracy of the masking threshold only causes a slight non-optimal coding order of the critical band as noted above, its impact on the compression performance is minimal. Therefore, it is acceptable to trade computational complexity versus the accuracy of masking threshold calculation. However, where increased accuracy is desired, either method may be employed in alternate embodiments of the EAC.

In particular, the first step in calculating the instantaneous auditory masking threshold involves first calculating the energy of the critical band. In particular, to calculate the auditory masking threshold, the average energy of the critical band in Equation 1 needs to be calculated first. The true average energy can only be calculated through a complex transform operation. However, it can be reasonably approximated with the energy of the transform coefficients in the real domain. Experimental results verify that such approximation produces an error of less than a few dBs, which results in a deviation of the masking threshold of less than one third of the bitplane.

To further speed up the calculation of the energy of the critical band, an "adjusted energy value" $E_{i,k}$ is introduced in a working example of the EAC for each critical band. $E_{i,k}$ records the total energy of the already coded coefficients of the critical band $s_{i,k}$ up to the current bitplane. The average energy is related to the adjusted energy value in accordance with Equation 6:

$$AVE_{i,k}=E_{i,k}\cdot 4^{M}/\text{sizeof}(s_{i,k}) \qquad \text{Equation 6}$$

where M is the current coding bitplane, and sizeof($s_{i,k}$) is the number of coefficients in critical band $s_{i,k}$.

One advantage of using the adjusted energy $E_{i,k}$ is that it can be calculated progressively. It is first initialized to zero. Then, during the coding process, whenever a significant coefficient is encountered (significant bit encoded as '1') in the PN and PS sub-bitplane, the adjusted energy $E_{i,k}$ is incremented by 1. Note that there is no change in the adjusted energy if the significant bit is encoded zero. During the REF sub-bitplane coding, the adjust energy $E_{i,k}$ does not change if the refinement bit is '0', and is incremented by a value of $2\cdot[b_{L-1}\ b_{L-2}\ldots b_M]-1$ if the refinement bit $b_M$ is '1'. Further, the adjustment energy $E_{i,k}$ is quadrupled (shifted by two bits) whenever an entire bitplane has been encoded. The calculation of the adjusted energy is thus only an incremental operation per significant bit identified, and one shift, one decrement and one addition operation per refinement bit '1' coded. Consequently, it is very computationally efficient.

The second step in calculating the instantaneous auditory masking threshold involves calculating the intra-band masking threshold. In particular, the masking threshold is expressed in terms of a bitplane, so that it can be evaluated against the ID of the sub-bitplane directly. It is related to the masking threshold in dB according to the formula provided in Equation 7, as follows:

$$TH(\text{bitplane})=TH(\text{dB})\cdot\log_2(10)/20, \qquad \text{Equation 7}$$

Combining Equations 1, 6, and 7, and using the bitplane to express the auditory masking threshold is illustrated by Equation 8, the intra-band masking threshold is calculated as follows:

$$\text{TH_INTRA}_{i,k}(bitplane) = M + \log_4\lfloor E_{i,k}\rfloor - C_k, \quad \text{Equation 8}$$

$$\text{with } C_k = \log_4(sizeof(s_{i,k})) + R_{fac}\frac{\log_2 10}{20}$$

where $C_k$ is a constant of critical band k that can be pre-calculated. Calculation of Equation 8 needs only a logarithmic operation and two additions of constant numbers per critical band, and is thus again very computationally efficient.

Finally, the third step in calculating the instantaneous auditory masking threshold involves calculating the combined auditory masking threshold. The combined auditory masking threshold can be calculated through the iteration of Equation 2 through Equation 4, which involves several maximum operations per critical band. It has been observed that the majority of the computational requirements lie in the first step, discussed above, as the second and third steps only involve operations on a critical band basis. However, even in the first step, the added complexity per coefficient is minor compared with the overall complexity of the entropy coder. Consequently, it has been observed in a working example of the EAC that that the added complexity of the implicit auditory masking operation is low in comparison to the entropy coder itself.

4.0 WORKING EXAMPLE

In a simple working example of the present invention, the program modules described in Section 2 reference to FIG. 4 in view of the detailed description provided in Section 3 were employed encode a group of audio files using the embedded audio coding with implicit auditory masking described herein. Details of a group of experiments illustrating the success of the system and method for embedded audio coding with implicit auditory masking are provided in the following section.

4.1 RESULTS

In order to demonstrate the necessity for, and applicability of, embedded audio coding with implicit auditory masking, audio coding experiments were performed to demonstrate the coding efficiency achieved by the embedded audio coder described herein in comparison to existing conventional audio encoders.

In particular, the performance of the sub-bitplane entropy coder with implicit auditory masking described herein, i.e., the EAC, was tested using conventional MPEG sound quality assessment materials (SQAM) available for test purposes at http://www.tnt.uni-hannover.de/project/mpeg/audio/sqam/. The SQAM materials are 44.1 kHz, 16 bit, stereo audio files that were converted to a mono channel and subsampled at 32 kHz. 16 audio file clips were used in the test. The EAC described herein was benchmarked against two conventional psychoacoustic audio encoders; the MPEG-4 standard (TwinVQ, profile #TV00 ) and the G.722.1 audio coding standard. The average noise-mask-ratios (NMR) of the 16 coded clips at coding bitrates of 48 kbps (kbits per second), 32 kbps, 24 kbps and 16 kbps are provided in Table 7.

TABLE 7

Average Noise Masking Ratio (NMR) of the Coders.

| Coder | 48 kbps | 32 kbps | 24 kbps | 16 kbps |
|---|---|---|---|---|
| EAC | −0.37 | 2.20 | 3.68 | 5.02 |
| MPEG-4 | 3.87 | 5.44 | 6.82 | 6.94 |
| G.722.1 | 6.28 | 6.86 | 7.41 | 8.56 |

It was observed that the EAC coder outperformed the MPEG-4 (TwinVQ) coder by 1.92 to 4.24 dB. Further, it was also observed that the EAC outperformed the G.722.1 coder by 3.54 to 6.65 dB. A subjective listening of the decoded audio clips, demonstrated a noticeable perceptual improvement in the quality of audio encoded with the EAC over the MPEG-4 and G.722.1 encoders. The perceptual quality improvement was especially large at lower bitrates for musical clips. This is because at low bitrates, as described above, the EAC can devote more bits to coefficient coding, as no side information needs to be sent for the auditory mask.

The foregoing description of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method for coding audio data comprising of using a computing device to:

transform an audio input to produce at least one set of transform coefficients;

split separate bits representing transform coefficients into at least one embedded coding unit (ECU);

set an initial auditory masking threshold; and sequentially entropy encode each ECU, wherein a first ECU is encoded using the initial masking threshold, and each subsequent entropy encoded ECU is entropy encoded using an auditory masking threshold which is automatically derived from a previously encoded coefficient.

2. The method of claim 1 wherein the audio input is transformed using a modulated lapped transform to produce the at least one set of transform coefficients.

3. The method of claim 1 wherein the audio input is transformed using wavelet transforms to produce the at least one set of transform coefficients.

4. The method of claim 1 wherein the initial auditory masking threshold is set to a quiet threshold of a human psychoacoustic masking model.

5. The method of claim 1 wherein the initial auditory masking threshold is set to a predetermined constant value.

6. The method of claim 1 wherein the audio input is multiplexed prior to transforming the audio to provide at least one separate audio channel.

7. The method of claim 6 wherein transforming the audio input comprises individually transforming each separate audio channel.

8. The method of claim 1 wherein each ECU consists of one bit of a transform coefficient.

9. The method of claim 1 wherein each ECU consists of more than one bit of a transform coefficient.

10. The method of claim 1 wherein each ECU is individually entropy encoded in order of each ECU's overall contribution to perceptual audio quality, with those ECUs providing a greater contribution to perceptual audio quality being encoded prior to those ECUs providing a lesser contribution to perceptual audio quality.

11. The method of claim 1 wherein the set of transform coefficients is automatically split into at least two critical bands.

12. The method of claim 11 wherein each ECU consists of bits of a same sub-bitplane of the same critical band.

13. The method of claim 1 wherein each ECU is automatically reordered prior to entropy encoding, and wherein the reordering ensures that those ECUs providing a greater contribution to perceptual audio quality are encoded prior to those ECUs providing a lesser contribution to perceptual audio quality.

14. The method of claim 1, wherein the transform coefficients are split into at least two sections;

the bits of each section of coefficients are further split into at least one ECUs, which are sequentially encoded; and a compressed bitstream of the sections is assembled according to each section's overall contribution to perceptual audio quality.

15. The method of claim 11, wherein sequentially entropy encoding ECUs further comprises performing the following steps:

a. calculate a maximum bitplane for all audio coefficients;

b. set progress indicators for all critical bands to a predicted insignificance sub-bitplane of the maximum bitplane, c. determine a next ECU to be encoded by calculating a gap between each progress indicator and the masking threshold of critical band, with the smallest gaps among all critical bands representing a current gap, and choosing the critical band with a gap value the same as the current gap to be encoded, and choosing the ECU to be the one in the chosen critical band, with a sub-bitplane pointed to by the progress indicator, d. encode the ECU by encoding individual bits using a context sensitive entropy coder, e. update the progress indicator to identify a next sub-bitplane to be encoded, f. update the masking threshold based on the already coded audio coefficients if the progress indicator has reached a predetermined checkpoint, g. determine whether a predetermined end criteria has been met, and h. iteratively repeat steps (b) through (g) until the predetermined end criterion is reached.

16. The method of claim 11 wherein automatically deriving the auditory masking threshold from a previously encoded coefficient comprises:

calculating an adjusted energy value for each critical band;

calculating an intra-band masking threshold from the adjusted energy value; and calculating a combined masking threshold from the intra-band masking thresholds of individual critical bands for deriving the auditory masking threshold.

17. The method of claim 16, wherein the calculation of the adjusted energy value of each critical band is accomplished by:

initializing the adjusted energy value of each critical band to zero;

performing one incremental operation per significant bit '1' encoded;

performing one shift, one decrement and one addition operation per refinement bit '1' encoded; and performing one shift operation per entire bitplane of the critical band have been encoded.

18. The method of claim 16, wherein the calculation of the intra-band masking threshold of the critical band from the adjusted energy value is accomplished by one logarithm and two addition operations.

19. The method of claim 16, wherein the calculation of the combined masking threshold from the intra-band masking thresholds of individual critical band is achieved by a set of maximum operations.

20. The method of claim 1 wherein the auditory masking threshold which is automatically derived from the previously encoded coefficient is updated only after a predetermined checkpoint has been reached.

21. The method of claim 2 wherein the modulated lapped transform is a fully reversible modulated lapped transform with integer calculation, and wherein the entropy encoding of the audio data is lossless.

22. The method of claim 1 wherein the encoded ECUs of each set of coefficients is assembled into an assembled bitstream.

23. The method of claim 22 further comprising streaming the assembled bitstream from a server computer to a remote client computer.

24. The method of claim 22 wherein the assembled bitstream is decoded by automatically deriving auditory masking thresholds directly from the encoded coefficients in the assembled bitstream without the use of an auditory mask and performing a reverse transform on the encoded coefficients using the automatically derived auditory masking thresholds to generate decoded audio components.

25. The method of claim 24 wherein the decoded audio components are combined to generate a decoded copy of the encoded audio data.

26. The method of claim 1 wherein sequentially entropy encoding ECUs continues until all bits of all coefficients have been encoded.

27. The method of claim 1 wherein sequentially entropy encoding ECUs continues until a predetermined coding bitrate has been reached.

28. The method of claim 1 wherein sequentially entropy encoding ECUs continues until a predetermined coding quality has been reached.

29. A system for psychoacoustic audio coding comprising:

transforming at least one channel of audio data to produce at least one set of transform coefficients;

setting an initial auditory masking threshold;

dividing bits of each transform coefficient into at least one coding group; and sequentially entropy encoding each coding group, wherein each coding group is entropy encoded using an auditory masking threshold which is sequentially derived from a previously encoded coding group, beginning with a first entropy encoded coding group that is entropy encoded using the initial masking threshold.

30. The system of claim 29 wherein the at least one channel of audio data is transformed using a modulated lapped transform to produce the at least one set of transform coefficients.

31. The system of claim 29 wherein the at least one channel of audio data is transformed using wavelet transforms to produce the at least one set of transform coefficients.

32. The system of claim 31 wherein the initial auditory masking threshold is set to a quiet threshold of a human psychoacoustic masking model.

33. The system of claim 31 wherein the initial auditory masking threshold is set to a predetermined constant value.

34. The system of claim 29 wherein the audio data is multiplexed prior to transforming the at least one channel to provide separate audio channels to be transformed.

35. The system of claim 29 wherein each encoded coding group is automatically assembled into a bitstream as it is entropy encoded.

36. The system of claim 29 wherein each coding group consists of at least one bit of a transform coefficient.

37. The system of claim 29 wherein each coding group is individually entropy encoded in order of each coding groups overall contribution to perceptual audio quality, with those coding groups providing a greater contribution to perceptual audio quality being encoded prior to those coding groups providing a lesser contribution to perceptual audio quality.

38. The system of claim 30 wherein the modulated lapped transform is a fully reversible modulated lapped transform with integer calculation, and wherein the entropy encoding of the audio data is lossless.

39. The system of claim 29 wherein each coefficient is automatically split into at least two sections prior to entropy encoding, with each section representing a predetermined portion of a frequency spectrum.

40. The system of claim 29 wherein each coefficient is split into a number of auditory critical bands, and wherein each critical band is separately entropy encoded using the automatically derived coefficients.

41. The system of claim 40 wherein at least one critical band of a coefficient is not encoded where the critical band of the coefficient would not produce a perceptual improvement in audio quality.

42. The system of claim 29 wherein sequentially entropy encoding at least one coding group continues until all coefficients have been encoded.

43. The system of claim 29 wherein sequentially entropy encoding at least one coding group continues until a predetermined coding bitrate has been reached.

44. The system of claim 29 wherein sequentially entropy encoding at least one coding group continues until a predetermined coding quality has been reached.

45. The system of claim 29 wherein the auditory masking threshold includes temporal audio masking.

46. The system of claim 40 further comprising determining a significance of each auditory critical band.

47. The system of claim 46 wherein any critical band which is determined to be insignificant is not encoded.

48. The system of claim 40 wherein a half harmonic of each coefficient is used to determine whether the coefficient is significant.

49. A computer-implemented process for decoding audio data encoded using psychoacoustic masking, comprising using a computing device to receive coded audio having entropy coded coeffifients:

automatically derive auditory masking thresholds directly from the entropy coded coefficients in encoded audio data without explicitly receiving an auditory mask;

perform a reverse transform on the encoded coefficients to generate decoded audio components; and combine the decoded audio components to generate a decoded copy of the encoded audio data.

50. The computer-implemented process of claim 49 wherein the encoded audio data is transmitted over a network from a server computer to at least one remote client computer.

51. The computer-implemented process of claim 49 wherein the combined audio components are demultiplexed to provide a composite audio signal.

52. A computer-readable medium having computer executable instructions for psychoacoustic encoding of audio data, said computer executable instructions comprising:

inputting an audio signal into the computer;

multiplexing the audio signal to separate individual audio channel components;

transforming each audio channel component to produce a set of coefficients for each audio channel component;

splitting bits of coefficients into at least one embedded coding unit (ECU); and performing the following steps:

(a) initializing an entropy encoder with an initial masking threshold, (b) determining a next ECU of the audio signal to be encoded, (c) entropy encoding the next ECU of the audio signal, (d) updating the initial masking threshold by automatically deriving a new masking threshold from the entropy encoded ECU that was encoded in step (c), and (e) repeating steps (b) through (d) until a desired endpoint is reached.

53. The computer-readable medium of claim 52 wherein a bitstream representing each encoded coefficient section is automatically combined into an assembled bitstream as it is entropy encoded.

54. The computer-readable medium of claim 53 further comprising streaming the assembled bitstream from a server computer to a remote client computer.

55. The computer-readable medium of claim 53 wherein the assembled bitstream is decoded by automatically deriving auditory masking thresholds directly from the encoded coefficients in the assembled bitstream without the use of an auditory mask and performing a reverse transform on the encoded coefficients using the automatically derived auditory masking thresholds to generate decoded audio components.

56. The computer-readable medium of claim 55 wherein the decoded audio components are combined to generate a decoded copy of the encoded audio data.

57. The computer-readable medium of claim 52 wherein the desired endpoint is that all coefficients have been encoded.

58. The computer-readable medium of claim 52 wherein the desired endpoint is that a desired coding bitrate has been reached.

59. The computer-readable medium of claim 52 wherein the desired endpoint is that a desired coding quality has been reached.

* * * * *